US009184528B2

(12) United States Patent
Chiba et al.

(10) Patent No.: US 9,184,528 B2
(45) Date of Patent: Nov. 10, 2015

(54) ELECTRONIC COMPONENT SOCKET

(71) Applicant: ALPS ELECTRIC CO., LTD., Ota-ku, Tokyo (JP)

(72) Inventors: Shigetomo Chiba, Tokyo (JP); Takeshi Murayama, Tokyo (JP); Hiroyuki Takaoka, Tokyo (JP); Takeki Uozumi, Tokyo (JP); Nobuyuki Okuda, Tokyo (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/463,918

(22) Filed: Aug. 20, 2014

(65) Prior Publication Data

US 2015/0064984 A1 Mar. 5, 2015

(30) Foreign Application Priority Data

Aug. 29, 2013 (JP) ..... 2013-177851
Apr. 3, 2014 (JP) ..... 2014-076919

(51) Int. Cl.

| | |
|---|---|
| ***H01R 12/00*** | (2006.01) |
| ***H01R 13/24*** | (2006.01) |
| ***H01R 12/71*** | (2011.01) |
| ***H01R 12/73*** | (2011.01) |

(52) U.S. Cl.

CPC ..... *H01R 13/2407* (2013.01); *H01R 12/714* (2013.01); *H01R 12/73* (2013.01); *H01R 13/2435* (2013.01)

(58) Field of Classification Search

CPC ..... H01R 23/722
USPC ..... 439/66, 71
See application file for complete search history.

(56) References Cited

U.S. PATENT DOCUMENTS

| | | | | |
|---|---|---|---|---|
| 4,571,014 | A * | 2/1986 | Robin et al. | 439/108 |
| 4,611,867 | A * | 9/1986 | Ichimura et al. | 439/101 |
| 5,620,340 | A * | 4/1997 | Andrews | 439/607.1 |
| 2007/0287315 | A1 | 12/2007 | Kubo et al. | |
| 2013/0303005 | A1 * | 11/2013 | Chiba et al. | 439/108 |
| 2013/0323969 | A1 * | 12/2013 | Uozumi et al. | 439/607.01 |

* cited by examiner

*Primary Examiner* — Phuong Dinh
(74) *Attorney, Agent, or Firm* — Hunton & Williams LLP

(57) ABSTRACT

An electronic component socket includes a shield plate set forming an opening portion, a movement member including a conductive member having a contact portion capable of contacting an electrode terminal of an electronic component, an elastic member which is electrically connectable to a wiring substrate, and includes a biasing portion having a biasing force and a base portion fixing the biasing portion. The movement member is disposed to move vertically above the elastic member in the opening portion, and the biasing portion elastically contacts the movement member. The shield plate set includes a protrusion protruding in the opening portion, the movement member includes a concave portion which engages with the protrusion, the conductive member includes an inclined surface portion which extends so as to be inclined on an opposite side of the concave portion, and the biasing portion of the elastic member elastically contacts the inclined surface portion.

8 Claims, 21 Drawing Sheets

ELECTRONIC COMPONENT SOCKET

CLAIM OF PRIORITY

This application contains subject matter related to and claims the benefit of Japanese Patent Application Nos. 2013-177851 filed on Aug. 29, 2013 and 2014-076919 filed on Apr. 3, 2014, the entire contents of which are incorporated herein by reference.

BACKGROUND OF THE DISCLOSURE

1. Field of the Disclosure

The present disclosure relates to an electronic component socket, and particularly, to an electronic component socket in which a removal preventing structure can be processed without being limited by a size of a conductive member and desired removal prevention strength can be obtained.

2. Description of the Related Art

In recent years, the number of instances where an electric connection between an electronic device and an electronic component used in the electronic device, particularly, an electronic component having a plurality of connection terminals is performed via an electronic component socket has increased. The electronic component socket is electrically connected to the electric device via soldering, conductive adhesive, or the like, and the electronic component is locked to the electronic component socket by press fitting, engagement such as snap-in, or the like, and is electrically connected to the electronic component socket by press welding. Accordingly, attachment of the electronic component to the electronic device is easily performed, and thus, a defect such as deformation of the connection terminal when the electronic component is attached does not easily occur.

As the electronic component socket, an electronic component socket disclosed in Japanese Unexamined Patent Application Publication No. 2008-021639 described below is known.

Hereinafter, with reference to FIG. 21, an electronic component socket 900 in Japanese Unexamined Patent Application Publication No. 2008-021639 will be described. FIG. 21 is a cross-sectional view showing a structure of a contact 940 included in the electronic component socket 900 disclosed in Japanese Unexamined Patent Application Publication No. 2008-021639.

As shown in FIG. 21, the electronic component socket 900 disclosed in Japanese Unexamined Patent Application Publication No. 2008-021639 includes an electronic component which can correspond so as to be connected, for example, the contact 940 which is a conductive member which is electrically connected to an integrated circuit package 980. The contact 940 includes a support 941. Moreover, the contact includes a first spring member 943 which extends the front aslant upward from the upper end of the support 941 and has a first contact portion 944 contacting an integrated circuit package 980 at a tip portion, and a second spring member 945 having a first contact member 946 which is bent from the first contact portion 944, extends rearward aslant downward, and has a first contact member 946 at a tip portion. Moreover, the contact includes a third spring member 947 which extends frontward aslant downward from the lower end of the support 941, has a second contact portion 948 contacting a print wiring board 960 at a tip portion, and forms a pair with the first spring member 943 interposing the support 941, and a fourth spring member 949 which is bent from the second contact portion 948, extends rearward aslant upward, and has a second contact member 951 which is disposed to contact the first contact member 946 at a tip portion. Moreover, the support 941 includes a lock claw 942 which is formed to be raised rearward. The contact 940 is accommodated in a contact accommodation chamber 925, and a locking groove 931 into which the lock claw 942 can be inserted is formed on an inner wall portion of the contact accommodation chamber 925. A second regulation wall 933, which can engage with the lock claw 942, is formed on the upper side of the locking groove 931. In addition, when the contact 940 is accommodated in the contact accommodation chamber 925, the lock claw 942 contacts the wall of the contact accommodation chamber 925. However, since the lock claw 942 has elasticity, the contact 940 can be easily attached to the contact accommodation chamber 925 by snap-in. When the integrated circuit package 980 is not attached to the electronic component socket 900, the contact 940 accommodated in the contact accommodation chamber 925 is pressed upward by its own elastic force, and thus, the lock claw 942 and the second regulation wall 933 of the locking groove 931 elastically contact each other. Accordingly, even when the integrated circuit package 980 is not attached to the electronic component socket 900, falling-out of the contact 940 can be prevented.

In the future, when a small-sized electronic component or an electronic component in which the number of the connection terminals per a unit area is increased is used, in the electronic component socket 900, the contact 940 and the contact accommodation chamber 925 are required to be smaller. However, if the size of the conductive member such as the contact 940 is decreased, it is difficult to process a removal preventing structure such as the lock claw 942, and there is a problem that a desired removal prevention strength cannot be obtained.

These and other drawbacks exist.

SUMMARY OF THE DISCLOSURE

Embodiments of the present disclosure provide an electronic component socket in which a removal preventing structure can be processed without being limited by a size of a conductive member and desired removal prevention strength can be obtained.

According to an example embodiment, an electronic component socket includes: a shield body configured to form an opening portion and have conductivity; a movement member which includes a conductive member having a contact portion capable of contacting an electrode terminal of an electronic component placed above the opening portion; and an elastic member which is configured to be electrically connectable to a wiring of a wiring substrate placed below the opening portion and includes a biasing portion having a biasing force and a base portion fixing the biasing portion. The movement member is disposed to move vertically above the elastic member in the opening portion, and the biasing portion elastically contacts the movement member. The shield body includes a protrusion protruding toward a center of the opening portion in the opening portion. The movement member includes a concave portion which engages with the protrusion. The conductive member includes an inclined surface portion which is formed on an opposite side of the concave portion and extends so as to be close to a side, on which the concave portion is provided, toward a lower side. The biasing portion of the elastic member elastically contacts the inclined surface portion.

According to an example embodiment, in the electronic component socket, the shield body may be formed of a metal plate, and the protrusion may be formed by protrusion-processing the metal plate.

Also, in the electronic component socket, the shield body may be integrally formed and may be formed of a resin molded piece to which metal plating is applied, and the protrusion may be formed by molding.

According to an example embodiment, in the electronic component socket, the shield body may include: a first protrusion which is provided on one side with respect to a first center line bisecting an opening end portion of the opening portion in a plan view and on one side with respect to a second center line orthogonal to the first center line, and protrudes in a center direction of the opening portion; and a second protrusion which is provided on the other side with respect to the first center line and on the other side with respect to the second center line, and protrudes in a direction opposite to the protrusion direction of the first protrusion. The movement member may include: a first concave portion which is provided on one side with respect to the first center line and on one side with respect to the second center line, and engages with the first protrusion; and a second concave portion which is provided on the other side with respect to the first center line and on the other side with respect to the second center line, and engages with the second protrusion. The inclined surface portion of the conductive member may include: a first inclined surface portion which is formed on a rear side of the first concave portion and extends so as to be close to the side, on which the first concave portion is provided, toward a lower side; and a second inclined surface portion which is formed on a rear side of the second concave portion and extends so as to be close to the side, on which the second concave portion is provided, toward a lower side. The biasing portion of the elastic member may include a first elastic contact portion which elastically contacts the first inclined surface portion, and a second elastic contact portion which elastically contacts the second inclined surface portion.

According to an example embodiment, an electronic component socket includes: a shield body configured to form an opening portion and have conductivity; a movement member which includes a conductive member having a contact portion capable of contacting an electrode terminal of an electronic component placed above the opening portion; and an elastic member which is configured to be electrically connectable to a wiring of a wiring substrate placed below the opening portion and includes a biasing portion having a biasing force and a base portion fixing the biasing portion. The movement member is disposed to move vertically above the elastic member in the opening portion, and the biasing portion elastically contacts the movement member. The movement member includes a protrusion protruding toward the shield body. The shield body includes a concave portion which engages with the protrusion in the opening portion. The conductive member includes an inclined surface portion which is formed on a rear side of the protrusion and extends so as to be close to a side, on which the protrusion is provided, toward a lower side. The biasing portion of the elastic member elastically contacts the inclined surface portion.

According to a sixth aspect of the present invention, in the electronic component socket, the shield body may be integrally formed and may be formed of a resin molded piece to which metal plating is applied, and the concave portion may be formed by molding.

According to an example embodiment, in the electronic component socket, the shield body may be formed of a metal plate, and the concave portion may be formed by protrusion-processing the metal plate.

Also, in the electronic component socket, the movement member may include: a first protrusion which is provided on one side with respect to a first center line bisecting an opening end portion of the opening portion in a plan view and on one side with respect to a second center line orthogonal to the first center line, and protrudes toward the shield body; and a second protrusion which is provided on the other side with respect to the first center line and on the other side with respect to the second center line, and protrudes in a direction opposite to the protrusion direction of the first protrusion. The shield body may include: a first concave portion which is provided on one side with respect to the first center line and on one side with respect to the second center line, and engages with the first protrusion; and a second concave portion which is provided on the other side with respect to the first center line and on the other side with respect to the second center line, and engages with the second protrusion. The inclined surface portion of the conductive member may include: a first inclined surface portion which is formed on a rear side of the first protrusion and extends so as to be close to the side, on which the first protrusion is provided, toward a lower side; and a second inclined surface portion which is formed on a rear side of the second protrusion and extends so as to be close to the side, on which the second protrusion is provided, toward a lower side. The biasing portion of the elastic member may include a first elastic contact portion which elastically contacts the first inclined surface portion, and a second elastic contact portion which elastically contacts the second inclined surface portion.

According to the various embodiments, since the protrusion is easily formed compared to a cut-and-raised portion, a reduction in the size can be more easily achieved. In addition, the conductive member included in the movement member includes the inclined surface portion which is formed on the rear side of the concave portion and extends so as to be close to the side on which the concave portion is provided toward the lower portion, and the biasing portion of the elastic member elastically contacts the inclined surface portion from the lower portion. Accordingly, the movement member is biased upward by the elastic force of the biasing portion, and is biased to the direction in which the protrusion is provided. That is, the concave portion is pressed to the protrusion, and thus, engagement between the protrusion and the concave portion is securely performed. Accordingly, a socket electronic component, in which a removal preventing structure can be processed without being limited by a size of the conductive member, and desired removal prevention strength can be obtained, can be provided.

Also, in various embodiments, since the shield body is formed of a metal plate, compared to a case where, for example, the shield body is formed of a plate-shaped member of a synthetic resin material and is subjected to the processing for providing conductivity, the shield body can be easily formed. Moreover, since the protrusion is formed by the protrusion-processing, compared to the cut-and-raised portion, there is an advantageous effect in that the reduction in the size can be easily achieved, damage does not easily occur, and yield can be improved.

According to an example embodiment, the shield body is formed of the resin molded piece which is integrally formed, and thus, compared to when a plurality of parts are formed to be combined, assembly is easily performed. In addition, when metal plating is applied to the surface, it is not necessary to apply the metal plating to each of the plurality of parts, and thus, frequency of the plating can be decreased. In addition, there is an advantageous effect in that the formation of the protrusion can be easily performed by a molding die.

According to an example embodiment, the first protrusion and the first concave portion are provided on one side with respect to the first center line bisecting the opening end portion of the opening portion in a plan view and on one side with respect to the second center line orthogonal to the first center line, the second protrusion and the second concave portion are provided on the other side with respect to the first center line and on the other side with respect to the second center line, and thus, the movement member is engaged at two locations, and falling-out of the movement member does not easily occur. In addition, the first inclined surface portion and the second inclined surface portion are biased in directions opposing each other in a plan view, respectively, and thus, the movement member is rotated along a plane perpendicular to the movement direction. Accordingly, the movement member is not easily inclined with respect to the movement direction, and the engagement between the protrusion and the concave portion is not easily released. That is, the shield body and the movement member engage with each other at two locations, the movement member is not easily inclined with respect to the movement direction, and the engagement between the protrusion and the concave portion is not easily released. Therefore, there is an advantageous effect in that the electronic component socket more easily capable of obtaining desired removal prevention strength can be provided.

According to an example embodiment, since the protrusion is more easily formed compared to a cut-and-raised portion, a reduction in the size can be more easily achieved. In addition, the conductive member included in the movement member includes the inclined surface portion which is formed on the rear side of the protrusion and extends so as to be close to the side on which the protrusion is provided toward the lower portion, and the biasing portion of the elastic member elastically contacts the inclined surface portion from the lower portion. Accordingly, the movement member is biased upward by the elastic force of the biasing portion, and is biased to the direction in which the concave portion is provided. That is, the protrusion is pressed to the concave portion, and thus, engagement between the protrusion and the concave portion is securely performed. Accordingly, an electronic component socket, in which the removal preventing structure can be processed without being limited by a size of the conductive member and desired removal prevention strength can be obtained, can be provided.

According to an example embodiment, the shield body is formed of the resin molded piece which is integrally formed, and thus, compared to when a plurality of parts are formed to be combined, assembly is easily performed. In addition, when metal plating is applied to the surface, it is not necessary to apply the metal plating to each of the plurality of parts, and thus, frequency of the plating can be decreased. In addition, there is an advantageous effect in that the formation of the concave portion can be easily performed by a molding die.

According to an example embodiment, since the shield body is formed of a metal plate, compared to a case where, for example, the shield body is formed of a plate-shaped member of a synthetic resin material and is subjected to the processing for providing conductivity, the shield body can be easily formed. Moreover, since the concave portion is formed by the protrusion-processing, compared to the cut-and-raised portion, there is an advantageous effect in that the reduction in the size can be easily achieved, damage does not easily occur, and yield can be improved.

According to an example embodiment, the conductive member included in the movement member includes the inclined surface portion which is formed on the rear side of the protrusion and extends so as to be close to the side on which the protrusion is provided toward the lower portion, and the biasing portion of the elastic member elastically contacts the inclined surface portion from the lower portion. Accordingly, the movement member is biased upward by the elastic force of the biasing portion, and is biased to the direction in which the concave portion is provided. That is, the protrusion is pressed to the concave portion, and thus, engagement between the protrusion and the concave portion is securely performed. Accordingly, an electronic component socket, in which the removal preventing structure can be processed without being limited by a size of the conductive member and desired removal prevention strength can be obtained, can be provided.

As described above, according to the example embodiments of the present disclosure, an electronic component socket, in which the removal preventing structure can be processed without being limited by a size of the conductive member, and desired removal prevention strength can be obtained, can be provided.

BRIEF DESCRIPTION OF THE DRAWINGS

FIG. 11A is an enlarged perspective view showing an outline of the electronic component socket, and FIG. 11B is an enlarged plan view showing a G portion shown in FIG. 11A viewed from a Z1 direction side, and the shape of an opening portion of a shield body shown in FIGS. 11A and 11B is schematically shown to be different from an actual shape;

FIG. 12A is a perspective view showing an outline of the movement member, and FIG. 12B is a perspective view showing the movement member when viewed from a Z2 direction side shown in FIG. 12A;

FIG. 13A is a perspective view showing an outline of the elastic member, FIG. 13B is a side view showing the elastic member when viewed from a Y2 direction side shown in FIG. 13A, and FIG. 13C is a side view showing the elastic member when viewed from an X2 direction side shown in FIG. 13A;

FIG. 14A is a perspective view showing a portion of the shield body, and FIG. 14B is an enlarged view showing an H portion shown in FIG. 14A viewed from the Z1 direction side;

FIG. 15A is an enlarged view showing the J portion viewed from the Z1 direction, and FIG. 15B is an enlarged view showing the J portion viewed from the Z2 direction side;

FIG. 17 shows a state where the socket is disposed on a wiring substrate, and contacts an electrode terminal of the electronic component;

FIG. 20A is a plan view showing a direction of the movement member when the movement member is inserted into the opening portion, and FIG. 20B is a plan view showing the direction of the movement member after the movement member is inserted into the opening portion.

DETAILED DESCRIPTION OF THE DISCLOSURE

The following description is intended to convey a thorough understanding of the embodiments described by providing a number of specific embodiments and details involving an electronic component socket. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

Hereinafter, an electronic component socket 100 in an example embodiment will be described.

Figure 1:
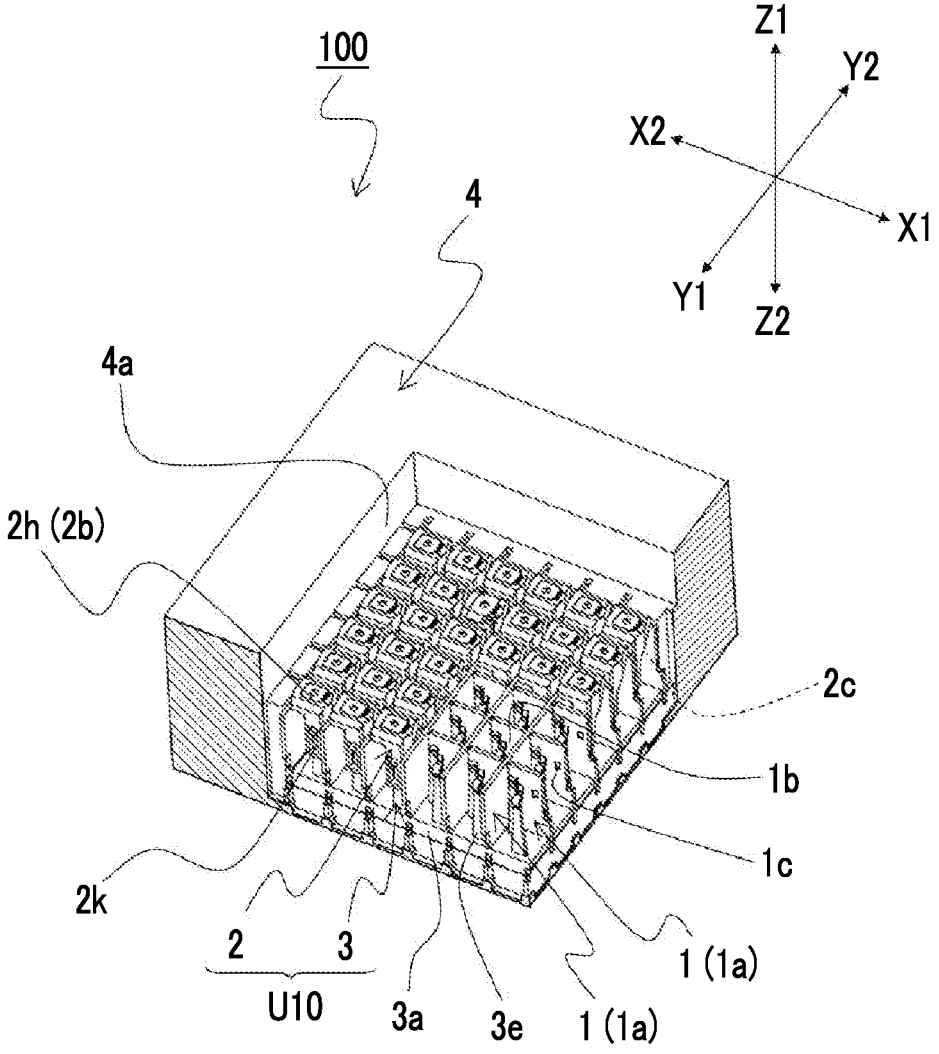
FIG. 1 is a perspective view showing a configuration of an electronic component socket in an embodiment of the disclosure.
Figure 2:
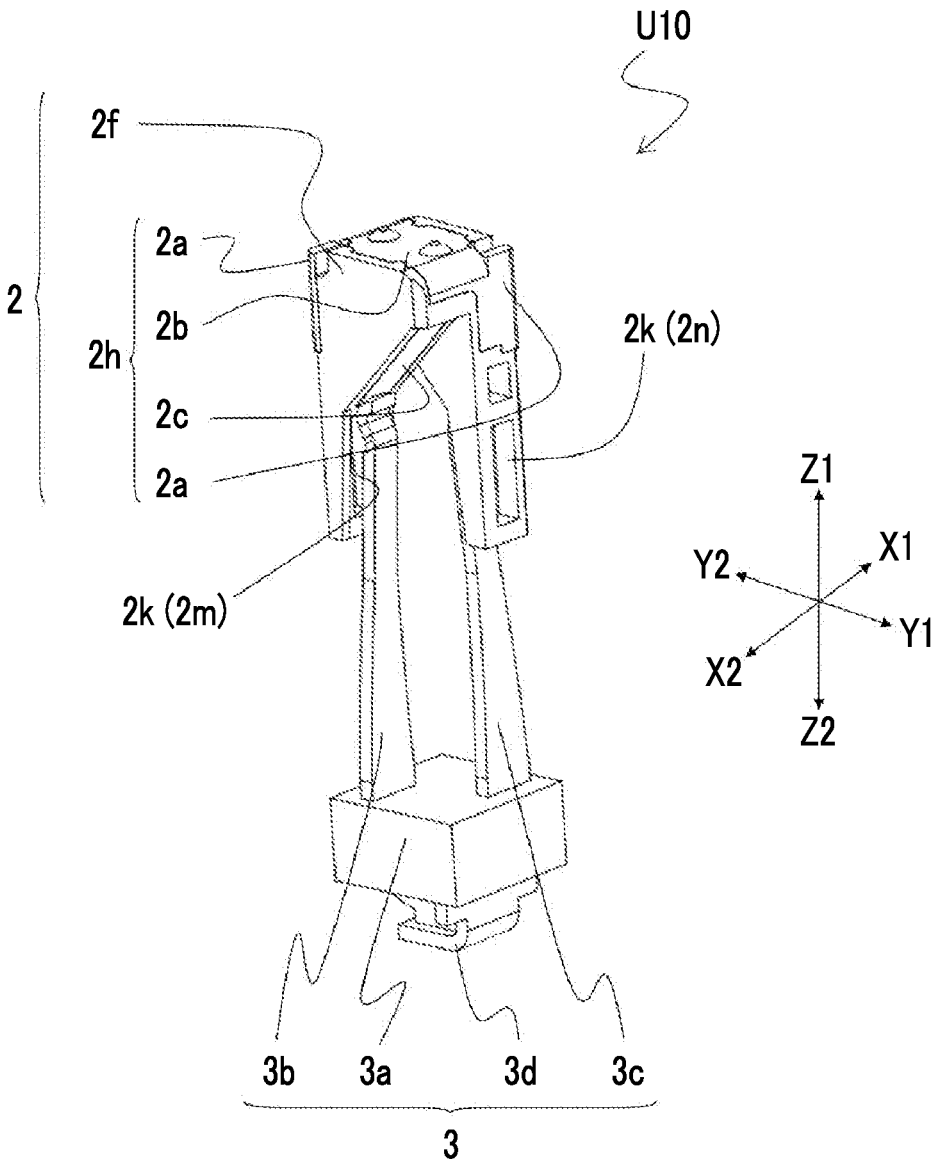
FIG. 2 is a perspective view showing a configuration of a contact unit in an embodiment of the disclosure.
Figure 3A:
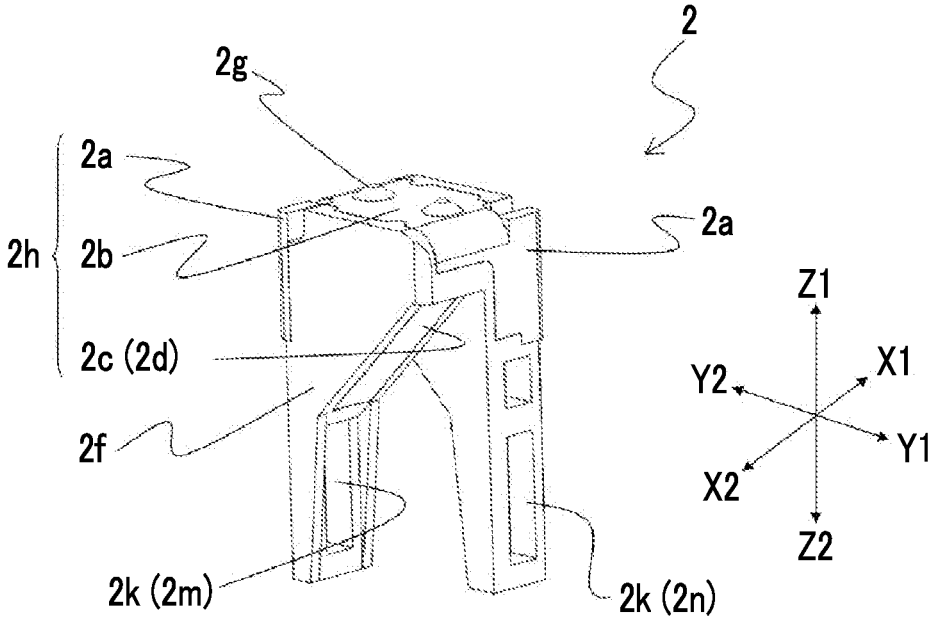
FIGS. 3A and 3B are views showing a movement member in an embodiment of the disclosure.
Figure 3B:
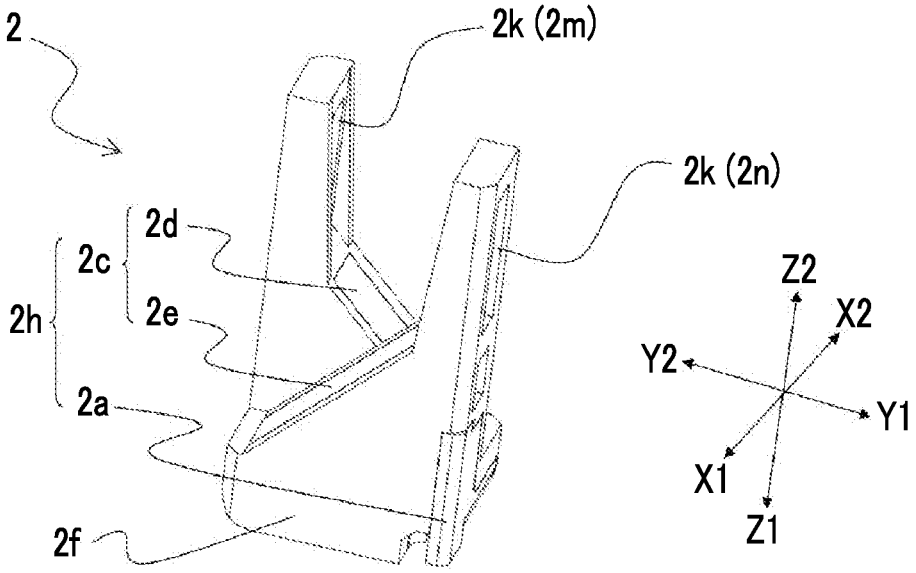
Figure 4:
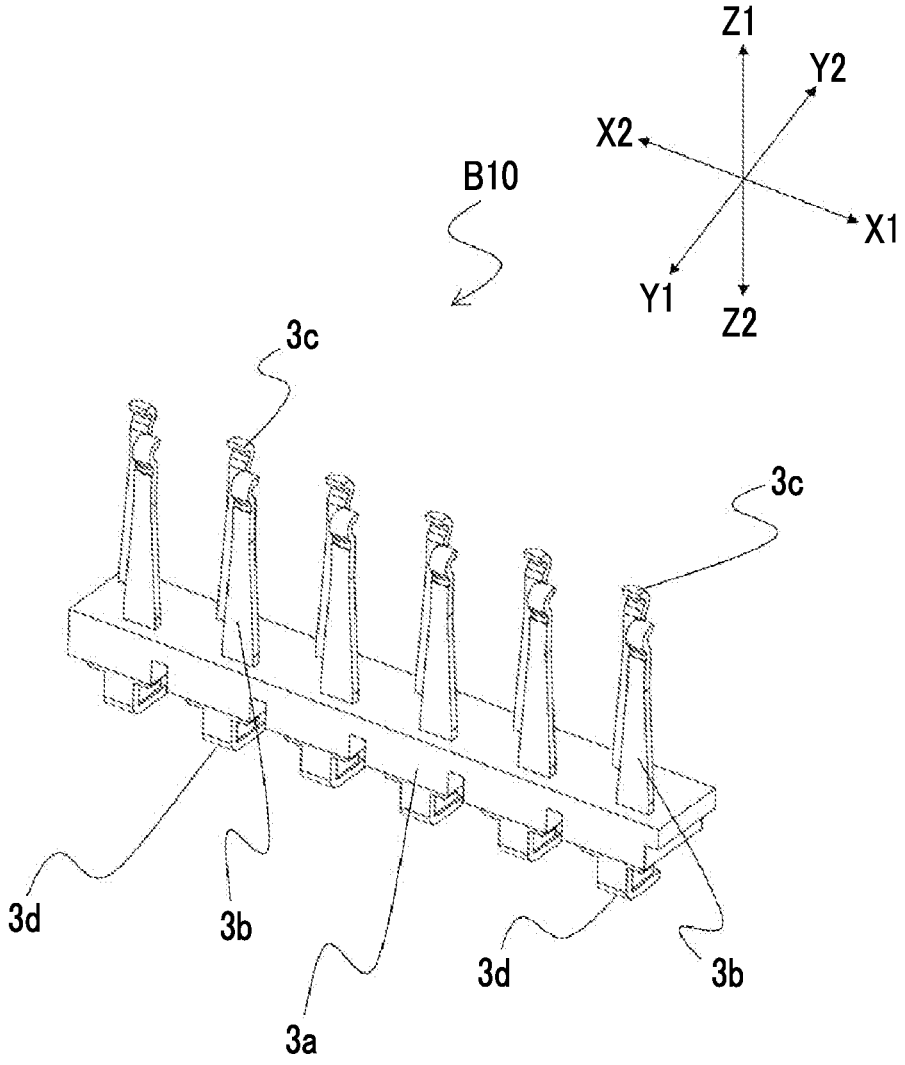
FIG. 4 is a perspective view showing a contact bar in an embodiment of the disclosure.
Figure 5:
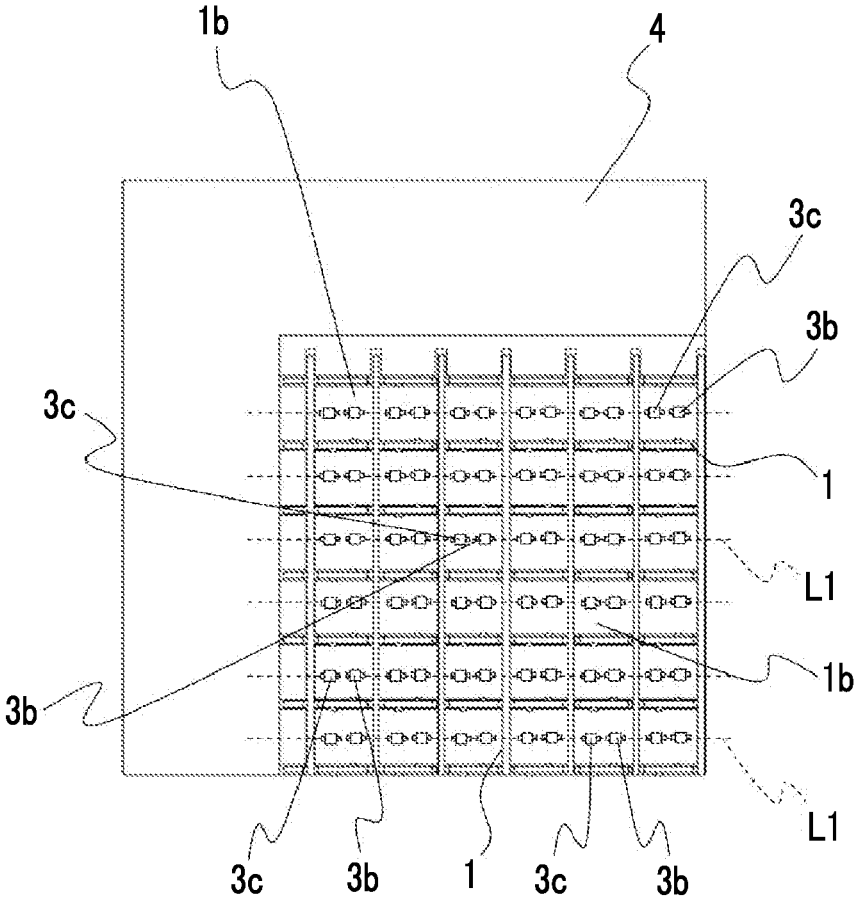
FIG. 5 is a plan view showing a disposition example of a first elastic contact portion and a second elastic contact portion in an embodiment of the disclosure.
Figure 6A:
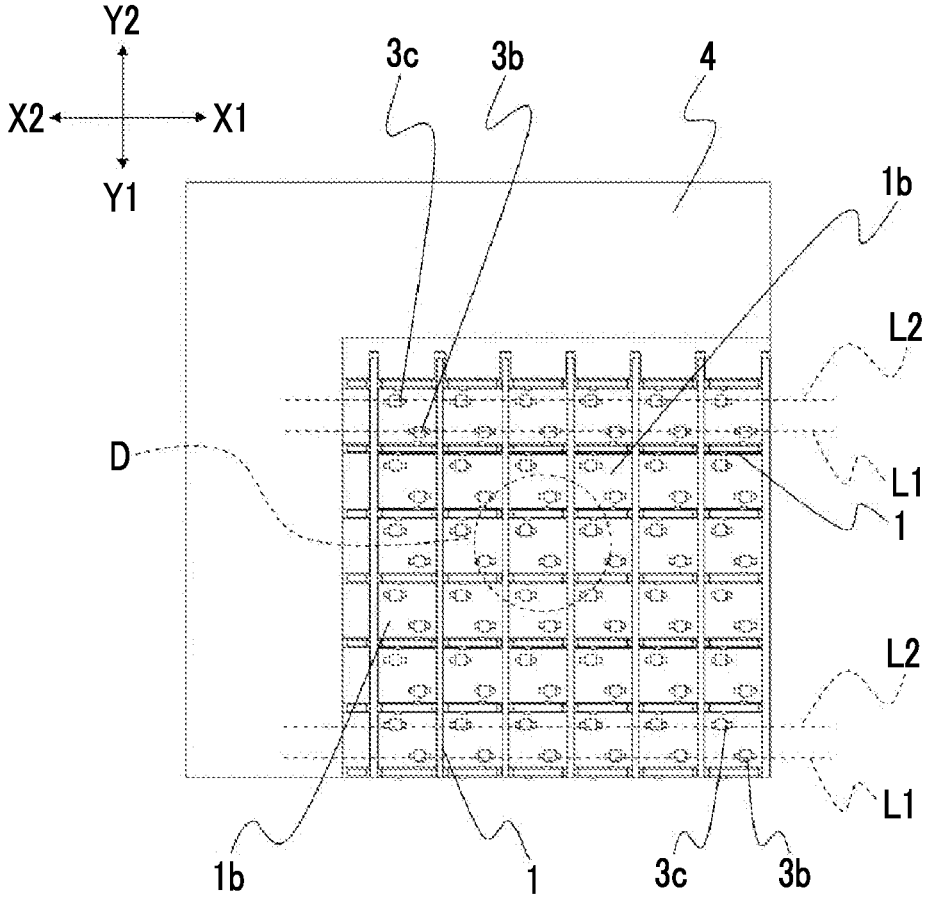
FIGS. 6A and 6B are plan views showing a disposition position of the first elastic contact portion and the second elastic contact portion in an embodiment of the disclosure.
Figure 6B:
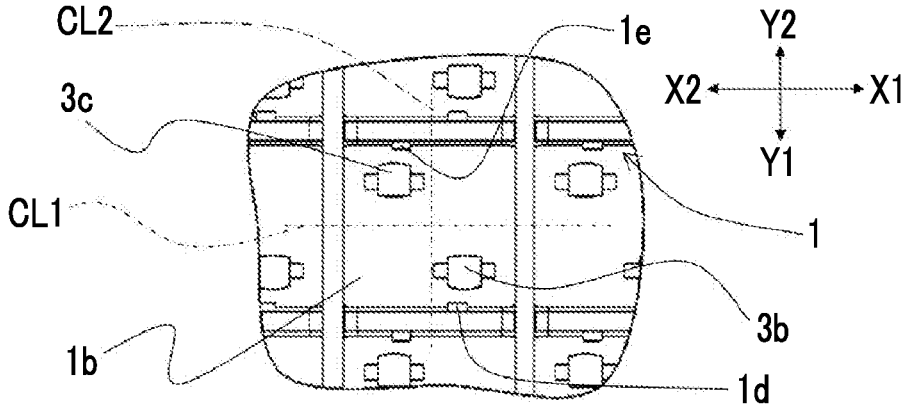
Figure 8A:
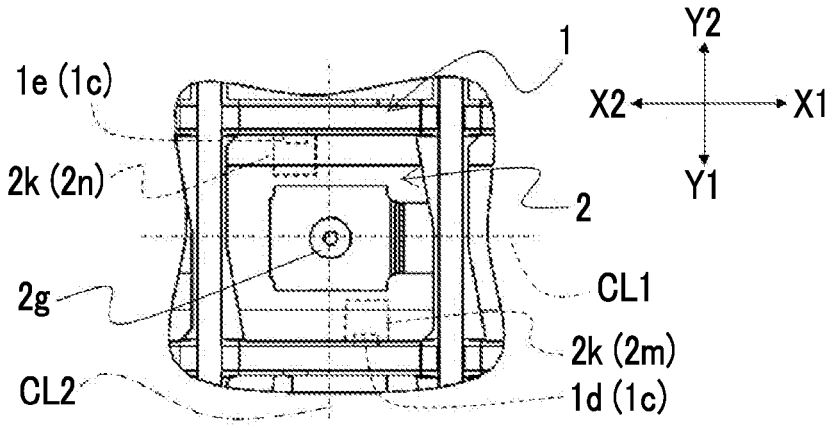
FIGS. 8A and 8B are views showing an engagement state between a protrusion and a concave portion in an embodiment of the disclosure.
Figure 8B:
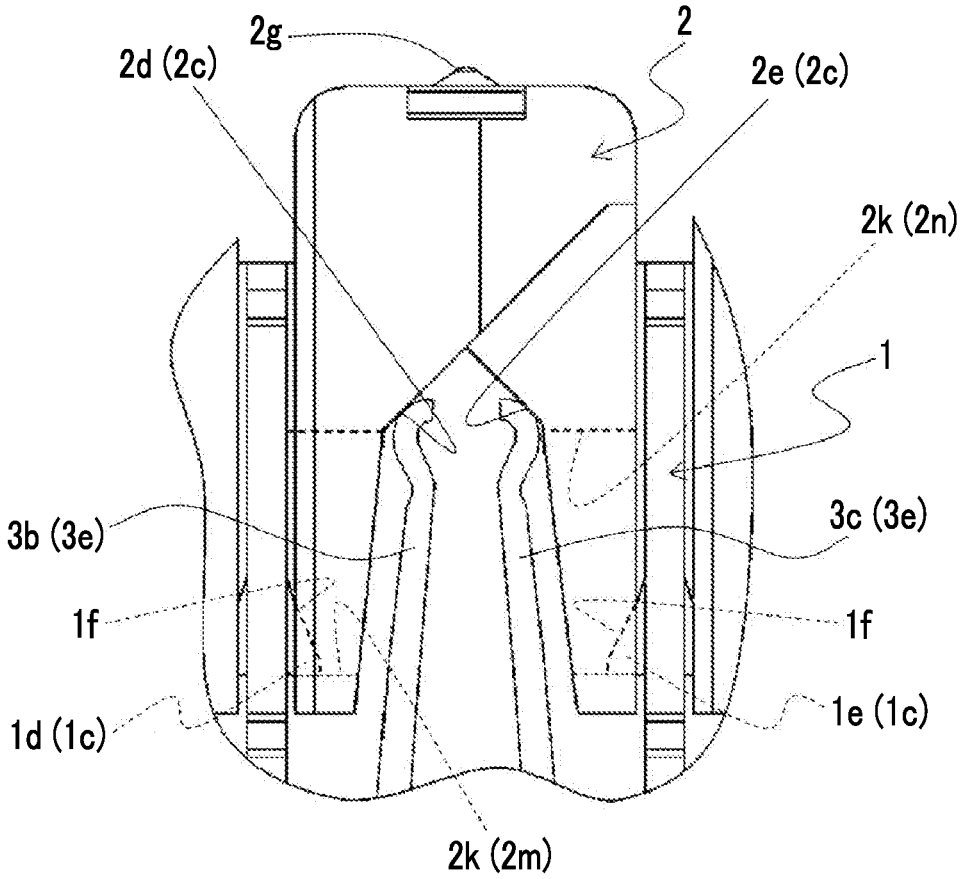

First, the configuration of the electronic component socket 100 will be described with reference to FIGS. 1 to 6B, and 8A and 8B. FIG. 1 is a perspective view showing the configuration of the electronic component socket 100. Moreover, for ease of explanation, in FIG. 1, the electronic component socket 100 is partially cut out, and a portion of movement members 2 is not shown. FIG. 2 is a perspective view showing a configuration of a contact unit U10. FIGS. 3A and 3B are views showing the movement member 2, FIG. 3A is a perspective view when the movement member 2 is viewed from the upper portion, and FIG. 3B is a perspective view when the movement member 2 is viewed from the lower portion. FIG. 4 is a perspective view showing a contact bar B10. FIG. 5 is a plan view showing a disposition example of a first elastic contact portion 3*b* and a second elastic contact portion 3*c*. FIGS. 6A and 6B are views showing a disposition position of the first elastic contact portion 3*b* and the second elastic contact portion 3*c* in the first embodiment, FIG. 6A is a plan view showing the disposition position of the first elastic contact portion 3*b* and the second elastic contact portion 3*c*, and FIG. 6B is an enlarged view showing a D portion shown in FIG. 6A. Moreover, in FIGS. 5, 6A, and 6B, for ease of explanation, the electronic component socket 100 is partially shown, and the movement member 2 is not shown. FIGS. 8A and 8B are views showing an engagement state between a protrusion 1*c* and a concave portion 2*k*, FIG. 8A is a plan view showing a protrusion 1*c* and a concave portion 2*k* viewed from the upper side, and FIG. 8B is a side view showing a state where FIG. 8A is viewed from the X2 direction side. Moreover, in FIG. 8B, a portion of a shield body 1 is not shown.

As shown in FIG. 1, the electronic component socket 100 may include the shield bodies 1 configured of a plurality of sheets of shield plates 1*a*, contact units U10 which may electrically connect electrode terminals TM (refer to FIGS. 7A to 7D) of electronic components and a wiring of a wiring substrate PB (refer to FIGS. 7A to 7D), and a housing 4 which can hold the shield bodies 1 and the contact units U10. As shown in FIGS. 1 and 2, the contact unit U10 may include the movement member 2 and an elastic member 3.

As shown in FIG. 1, in the shield body 1, the plurality of sheets of shield plates 1*a*, which may be configured of metal plate pieces and have conductivity, may be formed to be combined in a lattice shape so that the cross-section is formed in an approximately rectangular shape, and the shield body has an opening portion 1*b* in which a space is formed in the inner portion of the lattice. Moreover, the lattices formed by combining the shield plates 1*a* form rows and columns in two directions orthogonal to each other. The shield body 1 may include the protrusion 1*c* protruding toward a center of the opening portion 1*b* in the opening portion 1*b*, and the protrusion 1*c* may be formed by protrusion-processing the shield body 1 formed of a metal plate. Moreover, in the present embodiment, as shown in FIG. 6B, the protrusion 1*c* may include: a first protrusion 1*d* which may be provided on one side (Y1 direction side) with respect to a first center line CL1 bisecting an opening end portion of the opening portion 1*b* in a plan view and on one side (X1 direction side) with respect to a second center line CL2 orthogonal to the first center line CL1, and may protrude in the center direction of the opening portion 1*b*; and a second protrusion 1*e* which is provided on the other side (Y2 direction side) with respect to the first center line CL1 and on the other side (X2 direction side) with respect to the second center line CL2, and may protrude in a direction opposite to the protrusion direction of the first protrusion 1*d*. Moreover, the second center line CL2 also bisects the opening end portion. In addition, as shown in FIGS. 8A and 8B, a sliding inclination surface 1*f* which may be inclined downward in the protrusion direction of the protrusion 1*c* may be provided on the upper portion (Z direction side) of the protrusion 1*c*.

As shown in FIGS. 3A and 3B, the movement member 2 may be formed in an approximately rectangular parallelepiped shape. The movement member 2 may include a seat portion 2*f* and a conductive member 2*h*. The seat portion 2*f* may be formed of a synthetic resin material and in an approximately rectangular parallelepiped shape, and may include a concave portion 2*k* having a concave shape on the side surface. Moreover, in the present embodiment, the concave portion 2*k* may be formed as a through hole. The conductive member 2*h* may include a grounded contact portion 2*a* which may be electrically connectable to the shield body 1, a contact portion 2*b* which can contact the electrode terminal TM (refer to FIGS. 7A to 7D) of an electronic component having conductivity, and an inclined surface portion 2*c* which may be electrically connected to the contact portion 2*b*. The grounded contact portion 2*a*, the contact portion 2*b*, and the inclined surface portion 2*c* may be formed of one sheet of metal plate, and the grounded contact portion 2*a*, the contact portion 2*b*, and the inclined surface portion 2*c* may be electrically connected to one another. Moreover, the seat portion 2*f* and the conductive member 2*h* may be integrally formed, the contact portion 2*b* may be formed on the upper surface (the surface of the Z1 side) of the seat portion 2*f* with which the electrode terminal TM of the electronic component can contact, the grounded contact portion 2*a* may be formed on the side surface (the surface of the X1-X2 side or the surface of the Y1-Y2 side) of the seat portion 2*f*, and the inclined surface portion 2*c* may be formed on the lower surface (the surface of the Z2 side) of the seat portion 2*f*. Moreover, the inclined surface portion 2*c* may be formed on the rear side of the concave portion 2*k*, and extend so as to be close to the side, on which the concave portion 2*k* is provided, toward the lower portion. In addition, the plurality of movement members 2 may be disposed to correspond to the electrode terminals TM of the electron components, and may be classified into members which are used for grounding and members which are not used for grounding. When the movement member is the member which is not used for grounding, the grounded contact portion 2*a* is not formed.

Moreover, as shown in FIGS. 8A and 8B, the concave portion 2*k* may include: a first concave portion 2*m* which may be provided on one side (Y1 direction side) of the seat portion 2*f* with respect to the first center line CL1 and on one side (X1 direction side) with respect to the second center line CL2; and a second concave portion 2*n* which may be provided on the other side (Y2 direction side) of the seat portion 2*f* with respect to the first center line CL1 and on the other side (X2 direction side) with respect to the second center line CL2. In addition, the grounded contact portion 2*a* may be formed on the side surface on the Y1 direction side and the side surface on the Y2 direction side of the seat portion 2*f*. Moreover, the inclined surface portion 2*c* may include: a first inclined surface portion 2*d* which may be formed on the rear side of the first concave portion 2*m*, and may extend so as to be close to the side, on which the first concave portion 2*m* is provided, toward the lower portion, and a second inclined surface portion 2*e* which may be formed on the rear side of the second concave portion 2*n* and extend so as to be close to the side, on which the second concave portion 2*n* is provided, toward the lower portion, and a protruding portion 2*g* protruding in the Z1 direction may be formed on the contact portion 2*b*. One protruding portion 2*g* may be provided, or two protruding portions 2*g* may be provided if necessary.

As shown in FIG. 2, the elastic member 3 may include a biasing portion 3*e* which may be formed of a metal plate, and may have conductivity and a biasing force, and a base portion 3*a* which may be formed of a synthetic resin material and in a rectangular parallelepiped shape, and may fix the biasing portion 3*e*. The biasing portion 3*e* may protrude upward from the upper surface (the surface of the Z1 side) of the base portion 3*a*, may be formed in a cantilever spring shape, and can be displaced in the Y1-Y2 direction in FIG. 2. In addition, the elastic member 3 may include a contact portion 3*d* which may be formed to protrude from the lower surface (the surface of the Z2 side) of the base portion 3*a* being formed of a metal plate and can contact a wiring of the wiring substrate PB, and the biasing portion 3*e* may be electrically connected to the contact portion 3*d*. Accordingly, the biasing portion 3*e* may be electrically connectable to the wiring of the wiring substrate PB which is placed below the opening portion 1*b*. Moreover, in the present embodiment, the biasing portion 3*e* may include a first elastic contact portion 3*b* which may elastically contact the first inclined surface portion 2*d*, and a second elastic contact portion 3*c* which may elastically contact the second inclined surface portion 2*e*.

Moreover, the contact unit U10 shown in FIG. 2 has the configuration in which one set of first elastic contact portion 3*b* and second elastic contact portion 3*c* are provided on the base portion 3*a*. However, in the present embodiment, as shown in FIG. 4, a contact bar B10 in which a plurality of sets of first elastic contact portions 3*b* and second elastic contact portions 3*c* are provided on the base portion 3*a* may be used.

Moreover, as shown in FIG. 5, the first elastic contact portions 3*b* and the second elastic contact portions 3*c* may be configured so that bases of the first elastic contact portions 3*b* and bases of the second elastic contact portions 3*c* may be disposed in parallel on the same virtual straight line L1 assumed on the upper surface of the base portion 3*a*. However, in the present embodiment, as shown in FIGS. 6A and 6B, the bases of the first elastic contact portions 3*b* may be disposed on one virtual straight line L2 of two virtual parallel lines assumed on the upper surface of the base portion 3*a*, the bases of the second elastic contact portions 3*c* may be disposed on the other virtual straight line L3 of the two virtual parallel lines, and thus, the bases of the first elastic contact portions and the bases of the second elastic contact portions may be positioned at different positions along extension directions of the two virtual parallel lines.

As shown in FIG. 1, the housing 4 may be formed of a synthetic resin material and in an approximately rectangular parallelepiped shape, and may include an accommodation portion 4*a* in which the shield body 1 and the contact unit U10 can be disposed.

Next, the structure of the electronic component socket 100 will be described with reference to FIGS. 1 and 2. As shown in FIG. 1, the electronic component socket 100 may have the structure in which the contact units U10 are disposed in opening portions 1*b* of the lattice of the shield bodies 1. At this time, the movement member 2 is disposed to move vertically on the upper portion of the elastic member 3 in the opening portion 1*b*, and as shown in FIG. 2, is disposed in a state where the biasing portion 3*e* elastically contacts the inclined surface portion 2*c* of the movement member 2, that is, in a state where the first inclined surface portion 2*d* and the first elastic contact portion 3*b* abut each other and the second inclined surface portion 2*e* and the second elastic contact portion 3*c* elastically contact each other. Accordingly, the elastic member 3 is electrically connected to the wiring of the wiring substrate PB (refer to FIGS. 7A to 7D), is electrically connected to the inclined surface portion 2*c* of the movement member 2, and is electrically connectable to the electrode terminal TM (refer to FIGS. 7A to 7D) of the electronic component via the contact portion 2*b*. In addition, the movement member 2 may be disposed to be movable in the pressed direction (Z2 direction) according to the contact between the movement member and the electronic component. Moreover, the movement member 2 may be inserted into the opening portion 1*b* by snap-in, and after the insertion, the protrusion 1*c* formed in the opening portion 1*b* of the shield body 1 and the concave portion 2*k* of the movement member 2 engage with each other. That is, the first protrusion 1*d* and the first concave portion 2*m* may engage with each other, and the second protrusion 1*e* and the second concave portion 2*n* engage with each other. Therefore, the movement member 2 inserted in the opening portion 1*b* is held in the opening portion 1*b* in the state where the biasing portion 3*e* is bent.

Figure 7A:
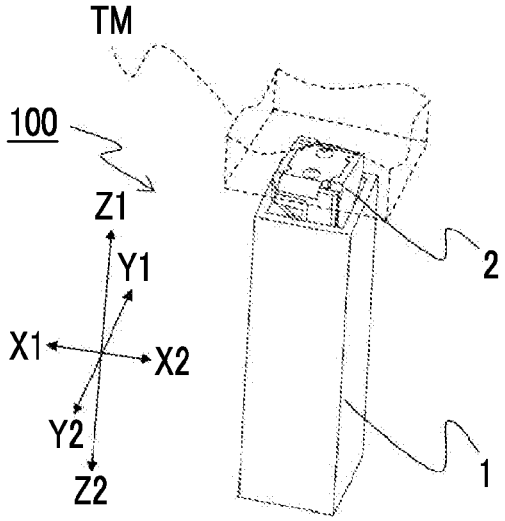
FIGS. 7A to 7D are views for an operation explanation of the electronic component socket in an embodiment of the disclosure.
Figure 7B:
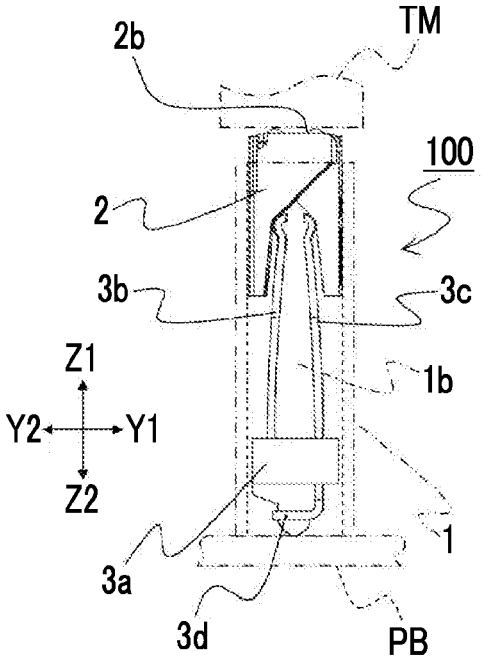
Figure 7C:
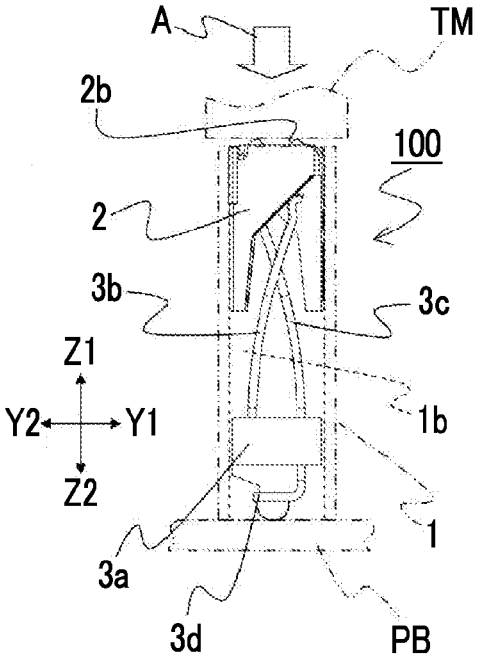
Figure 7D:
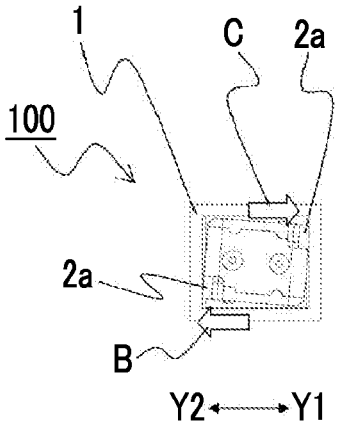

Next, the operation of the electronic component socket 100 will be described with reference to FIGS. 7A to 7D. FIGS. 7A to 7D are views for an operational explanation of the electronic component socket 100, FIG. 7A is a perspective view showing the electronic component socket 100, FIG. 7B is a side view showing the electronic component socket 100 in an initial state, FIG. 7C is a side view showing the electronic component socket 100 after the operation, and FIG. 7D is a top view showing the electronic component socket 100 after the operation. Moreover, in FIGS. 7A to 7D, for ease of explanation, the operation in one set of contact unit U10 is described.

If the electronic component is attached to the electronic component socket 100, first, as shown in FIG. 7B, the electrode terminal TM of the electronic component placed above the opening portion 1*b* and the contact portion 2*b* of the movement member 2 contact each other, and the electric connection between the electronic component and the electronic component socket 100 is realized. Thereafter, as shown in FIG. 7C, if the movement member 2 is pressed in a direction of an arrow A, the first elastic contact portion 3*b* may be bent along the first inclined surface portion 2*d*, the second elastic contact portion 3*c* may be bent along the second inclined surface portion 2*e*, the movement member 2 may move in the direction of the arrow A, and the electric connection between the electronic component and the electronic component socket 100 becomes more stable. At this time, according to the movement of the movement member 2, the force biased in the direction against the movement of the movement member 2 may be applied to the first inclined surface portion 2*d* and the second inclined surface portion 2*e* from the first elastic contact portion 3*b* and the second elastic contact portion 3*c*. Accordingly, a component force in a direction perpendicular to the direction against the movement of the movement member 2 may be applied to the first inclined surface portion 2*d* and the second inclined surface portion 2*e*. As shown in FIG. 7D, the component force may be operated in directions of an arrow B and an arrow C, a rotational moment may be operated in the movement member 2, the movement member 2 may be rotated about a virtual axis parallel to the movement direction of the movement member 2, and the grounded contact portion 2*a* and the inner circumferential surface of the shield body 1 contact each other. Accordingly, when the contact unit U10 is used for grounding, the grounded contact portion 2*a* may be electrically connected to the inner circumferential surface of the shield body 1, and can be grounded. Moreover, coating, plating, or the like having insulation properties may be applied to the shield plate 1*a* at the location corresponding to the contact unit U10 which is not used for grounding, and thus, even when the grounded contact portion 2*a* of the contact unit U10 which is not used for grounding and the shield body 1 contact each other, the grounding is not realized. Moreover, when the contact unit U10 is used for grounding, although it is not shown, the contact portion 3*d* and the shield body 1 may be electrically connected to each other by a method such as connecting using a circuit or connecting using conductive adhesive or solder. In addition, the force is operated in the directions of arrows B and C, the rotational moment is operated in the movement member 2, and thus, the concave portion 2*k* is biased toward the protrusion 1*c*.

In addition, if the electronic component is removed from the electronic component socket 100, the movement member 2 is returned to the position of the initial state shown in FIG. 7B by the biasing forces of the first elastic contact portion 3*b* and the second elastic contact portion 3*c*. Since the concave portion 2*k* engages with the protrusion 1*c* of the shield body, the movement member 2 returned to the position of the initial state is prevented from being removed so that the movement member does not fall off from the opening portion 1*b* of the shield body 1.

In the electronic component socket 100 of the present embodiment, the electronic component socket may include: the shield body 1 which forms the opening portion 1*b* and has conductivity; the movement member 2 which may include the conductive member 2*h* having the contact portion 2*b* capable of contacting the electrode terminal TM of the electronic component placed above the opening portion 1*b*; and the elastic member 3 which may be electrically connectable to the wiring of the wiring substrate PB placed below the opening portion 1*b* and may include the biasing portion 3*e* having the biasing force and the base portion 3*a* fixing the biasing portion 3*e*, in which the movement member 2 is disposed to move vertically above the elastic member 3 in the opening portion 1*b*, and the biasing portion 3*e* elastically contacts the movement member 2, the shield body 1 may include the protrusion 1*c* protruding toward the center side of the opening portion 1*b* in the opening portion 1*b*, the movement member 2 may include the concave portion 2*k* which engages with the protrusion 1*c*, the conductive member 2*h* may include the inclined surface portion 2*c* which may be formed on the rear side of the concave portion 2*k* and may extend so as to be close to the side, on which the concave portion 2*k* is provided, toward the lower portion, and the biasing portion 3*e* of the elastic member elastically contacts the inclined surface portion 2*c*.

Accordingly, since the protrusion 1*c* is easily formed compared to a cut-and-raised portion, a reduction in the size can be easily achieved. In addition, the conductive member 2*h* included in the movement member 2 may include the inclined surface portion 2*c* which may be formed on the rear side of the concave portion 2*k* and may extend so as to be close to the side on which the concave portion 2*k* is provided toward the lower portion, and the biasing portion 3*e* of the elastic member 3 elastically contacts the inclined surface portion 2*c* from the lower portion. Accordingly, the movement member 2 may be biased upward by the elastic force of the biasing portion 3*e*, and may be biased to the direction in which the protrusion 1*c* is provided. That is, the concave portion 2*k* may be pressed to the protrusion 1*c*, and thus, engagement between the protrusion 1*c* and the concave portion 2*k* may be securely performed. Accordingly, the electronic component socket, in which the removal preventing structure can be processed without being limited by a size of the conductive member 2*h* and desired removal prevention strength can be obtained, can be provided.

In addition, in the electronic component socket 100 of the present embodiment, the shield body 1 may be formed of a metal plate, and the protrusion 1*c* may be formed by protrusion-processing the shield body 1 formed of a metal plate.

Accordingly, since the shield body 1 is formed of a metal plate, compared to a case where, for example, the shield body is formed of a plate-shaped member of a synthetic resin material and is subjected to the processing for providing conductivity, the shield body can be easily formed. Moreover, since the protrusion 1*c* may be formed by the protrusion-processing, compared to the cut-and-raised portion, there is an advantageous effect in that the reduction in the size can be easily achieved, damage does not easily occur, and yield can be improved.

In addition, in the electronic component socket 100 of the present embodiment, the shield body 1 may include: the first protrusion 1*d* which may be provided on one side with respect to the first center line CL1 bisecting the opening end portion of the opening portion 1*b* in a plan view and on one side with respect to the second center line CL2 orthogonal to the first center line CL1, and may protrude in the center direction of the opening portion 1*b*; and the second protrusion 1*e* which may be provided on the other side with respect to the first center line CL1 and on the other side with respect to the second center line CL2, and may protrude in a direction opposite to the protrusion direction of the first protrusion 1*d*, the movement member 2 may include: the first concave portion 2*m* which may be provided on one side with respect to the first center line CL1 and on one side with respect to the second center line CL2, and may engage with the first protrusion 1*d*; and the second concave portion 2*n* which may be provided on the other side with respect to the first center line CL1 and on the other side with respect to the second center line CL2, and may engage with the second protrusion 1*e*, the inclined surface portion 2*c* of the conductive member 2*h* may include: the first inclined surface portion 2*d* which may be formed on the rear side of the first concave portion 2*m* and may extend so as to be close to the side, on which the first concave portion 2*m* is provided, toward the lower portion; and a second inclined surface portion 2*e* which may be formed on the rear side of the second concave portion 2*n* and may extend so as to be close to the side, on which the second concave portion 2*n* is provided, toward the lower portion, and the biasing portion 3*e* of the elastic member 3 may include the first elastic contact portion 3*b* which elastically contacts the first inclined surface portion 2*d*, and the second elastic contact portion 3*c* which elastically contacts the second inclined surface portion 2*e*.

Accordingly, the first protrusion 1*d* and the first concave portion 2*m* may be provided on one side with respect to the first center line CL1 bisecting the opening end portion of the opening portion 1*b* in a plan view and on one side with respect to the second center line CL2 orthogonal to the first center line CL1, the second protrusion 1*e* and the second concave portion 2*n* may be provided on the other side with respect to the first center line CL1 and on the other side with respect to the second center line CL2, and thus, the movement member 2 may be engaged at two locations, and falling-out of the movement member 2 does not easily occur. In addition, the first inclined surface portion 2*d* and the second inclined surface portion 2*e* are biased in directions opposing each other in a plan view, respectively, and thus, the movement member 2 is rotated along a plane perpendicular to the movement direction. Accordingly, the movement member 2 is not easily inclined with respect to the movement direction, and the engagement between the protrusion 1*c* and the concave portion 2*k* is not easily released. That is, the shield body 1 and the movement member 2 engage with each other at two locations, the movement member 2 is not easily inclined with respect to the movement direction, and the engagement between the protrusion 1*c* and the concave portion 2*k* is not easily released. Therefore, there is an advantageous effect in that the electronic component socket more easily capable of obtaining desired removal prevention strength can be provided.

In the electronic component socket 100 as described above, the elastic member 3 may include two biasing portions 3*e* of the first elastic contact portion 3*b* and the second elastic contact portion 3*c*, the movement member 2 may include two inclined surface portions 2*c* of the first inclined surface portion 2*d* and the second inclined surface portion 2*e*, and two concave portions 2*k* of the first concave portion 2*m* and the second concave portion 2*n*, and the shield body 1 may include two protrusions 1*c* of the first protrusion 1*d* and the second protrusion 1*e*. The electronic component socket 200 may include one protrusion 1*c* of the shield body 1, one biasing portion 3*e* of the elastic member 3, and one inclined surface portion 2*c* and one concave portion 2*k* of the movement member 2. In below descriptions, the detailed descriptions are omitted with respect to structures similar to the electronic component socket 100 described above, and constitution part names, part names, and reference numerals of the electronic component socket 100 are used.

Figure 9:
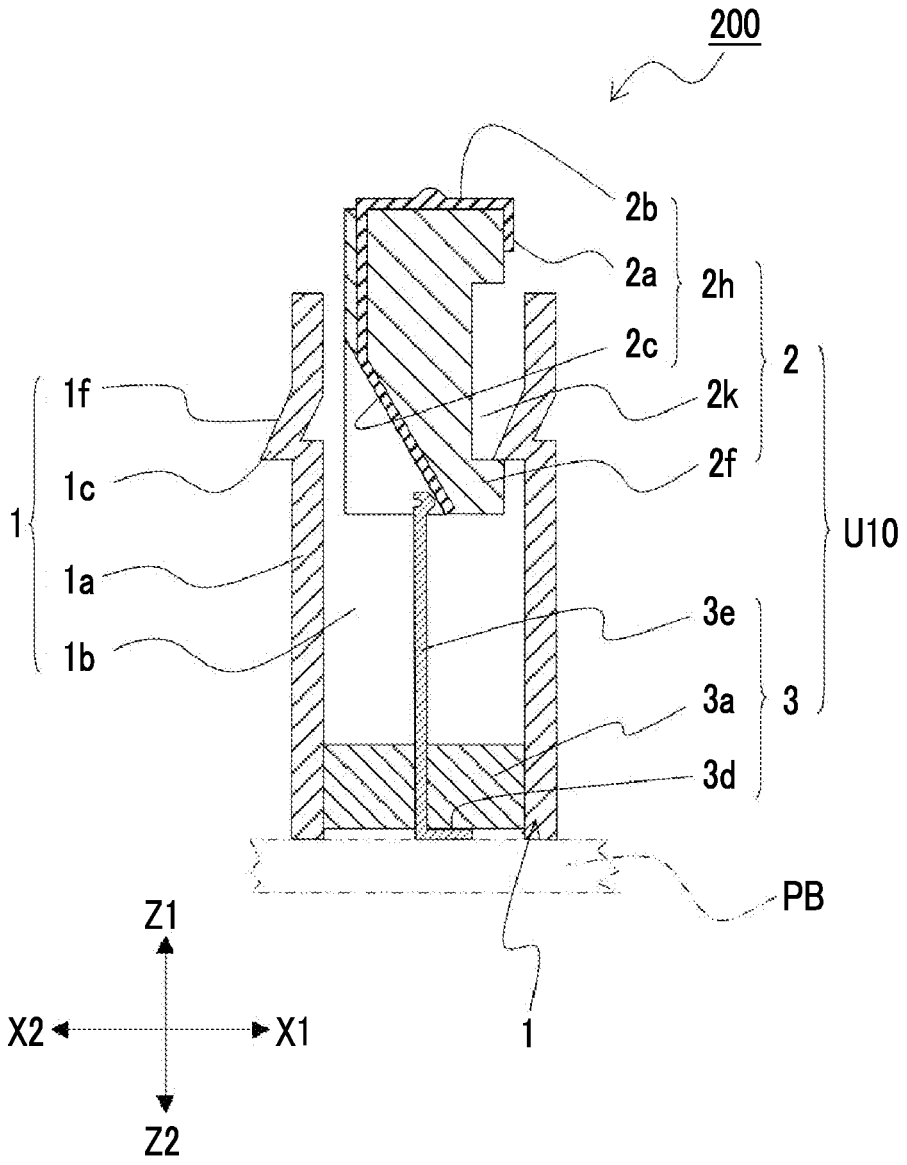
FIG. 9 is a schematic view showing a configuration of an electronic component socket in a second embodiment.

First, the configuration of the electronic component socket 200 will be described with reference to FIG. 9. FIG. 9 is a schematic view showing the configuration of the electronic component socket 200 according to an example embodiment. In addition, in FIG. 9, only a portion of the electronic component socket 200 is shown, and the housing 4 is not shown.

As shown in FIG. 9, the electronic component socket 200 may include shield bodies 1 configured of the plurality of sheets of shield plates 1*a*, contact units U10 which electrically connect electrode terminals TM (refer to FIG. 10) of electronic components and the wiring of the wiring substrate PB, and a housing 4 (not shown) which can hold the shield bodies 1 and the contact units U10. The contact unit U10 may include the movement member 2 and the elastic member 3.

As shown in FIG. 9, in the shield body 1, the plurality of sheets of shield plates 1*a*, which may be composed of metal plate pieces and have conductivity, are formed to be combined in a lattice shape so that the cross-section is formed in an approximately rectangular shape, and the shield body may have an opening portion 1*b* in which a space is formed in the inner portion of the lattice. Moreover, the lattices formed by combining the shield plates 1*a* form rows and columns in two directions orthogonal to each other. The shield body 1 may include one protrusion 1*c* protruding toward a center of the opening portion 1*b* in the opening portion 1*b*, and the protrusion 1*c* is formed by protrusion-processing the shield body 1.

As shown in FIG. 9, the movement member 2 is formed in an approximately rectangular parallelepiped shape. The movement member 2 may include the seat portion 2*f* and the conductive member 2*h*. The seat portion 2*f* may be formed of a synthetic resin material, may be formed in an approximately rectangular parallelepiped shape, and may include a concave portion 2*k* which may be formed in a concave shape on one side surface (the side surface of the X1 direction side). The conductive member 2*h* may include a grounded contact portion 2*a* which may be electrically connectable to the shield body 1, a contact portion 2*b* which can contact the electrode terminal TM (refer to FIG. 10) of an electronic component providing conductivity, and an inclined surface portion 2*c* which may be electrically connected to the contact portion 2*b*. The grounded contact portion 2*a*, the contact portion 2*b*, and the inclined surface portion 2*c* may be formed of one sheet of metal plate, and the grounded contact portion 2*a*, the contact portion 2*b*, and the inclined surface portion 2*c* may be electrically connected to one another. Moreover, the seat portion 2*f* and the conductive member 2*h* may be integrally formed, the contact portion 2*b* may be formed on the upper surface (the surface of the Z1 side) of the base portion 2*f* with which the electrode terminal TM of the electronic component can contact, the grounded contact portion 2*a* may be formed on the side surface (the surface on the X1 direction side) on which the concave portion 2*k* of the seat portion 2*f* is formed, and the inclined surface portion 2*c* may be formed on the lower surface (the surface of the Z2 side) of the base portion 2*f*. Moreover, the inclined surface portion 2*c* may be formed on the rear side of the concave portion 2*k*, and may extend so as to be close to the side, on which the concave portion 2*k* is provided, toward the lower portion. In addition, the movement member 2 shown in FIG. 9 may correspond to the terminal for grounding, and when the movement member corresponds to the terminal which is not used for grounding, the grounded contact portion 2*a* may not be formed.

As shown in FIG. 9, the elastic member 3 may include a biasing portion 3*e* which may be formed of a metal plate, and may have conductivity and a biasing force, and a base portion 3*a* which may be formed of a synthetic resin material, may be formed in a rectangular parallelepiped shape, and may fix the biasing portion 3*e*. The biasing portion 3*e* may protrude upward from the center portion of the upper surface (the surface of the Z1 side) of the base portion 3*a*, may be formed in one cantilever spring shape, and can be displaced in the X1-X2 direction in FIG. 9. In addition, the elastic member 3 may include a contact portion 3*d* which may be formed to protrude from the lower surface (the surface of the Z2 side) of the base portion 3*a* being formed of a metal plate and can contact the wiring of the wiring substrate PB, and the biasing portion 3*e* may be electrically connected to the contact portion 3*d*. Accordingly, the biasing portion 3*e* may be electrically connectable to the wiring of the wiring substrate PB which may be placed below the opening portion 1*b*.

The housing 4 (not shown) may be formed of a synthetic resin material, may be formed in an approximately rectangular parallelepiped shape, and may be formed to dispose the shield body 1 and the contact unit U10.

As shown in FIG. 9, the electronic component socket 200 may have the structure in which the contact units U10 are disposed in opening portions 1*b* of the lattices of the shield bodies 1. At this time, the movement member 2 may be disposed to move vertically on the upper portion of the elastic member 3 in the opening portion 1*b*, and may be disposed in the state where the biasing portion 3*e* elastically contacts the inclined surface portion 2*c* of the movement member 2. Accordingly, the elastic member 3 may be electrically connected to the wiring of the wiring substrate PB (refer to FIG. 10), may be electrically connected to the inclined surface portion 2*c* of the movement member 2, and may be electrically connectable to the electrode terminal TM (refer to FIG. 10) of the electronic component via the contact portion 2*b*. In addition, the movement member 2 may be disposed to be movable in the pressed direction (Z2 direction) according to the contact between the movement member and the electronic component. Moreover, the movement member 2 may be inserted into the opening portion 1*b* by snap-in, and after the insertion, the protrusion 1*c* formed in the opening portion 1*b* of the shield body 1 and the concave portion 2*k* of the movement member 2 engage with each other. Therefore, the movement member 2 inserted in the opening portion 1*b* may be held in the opening portion 1*b* in the state where the biasing portion 3*e* is bent.

Figure 10:
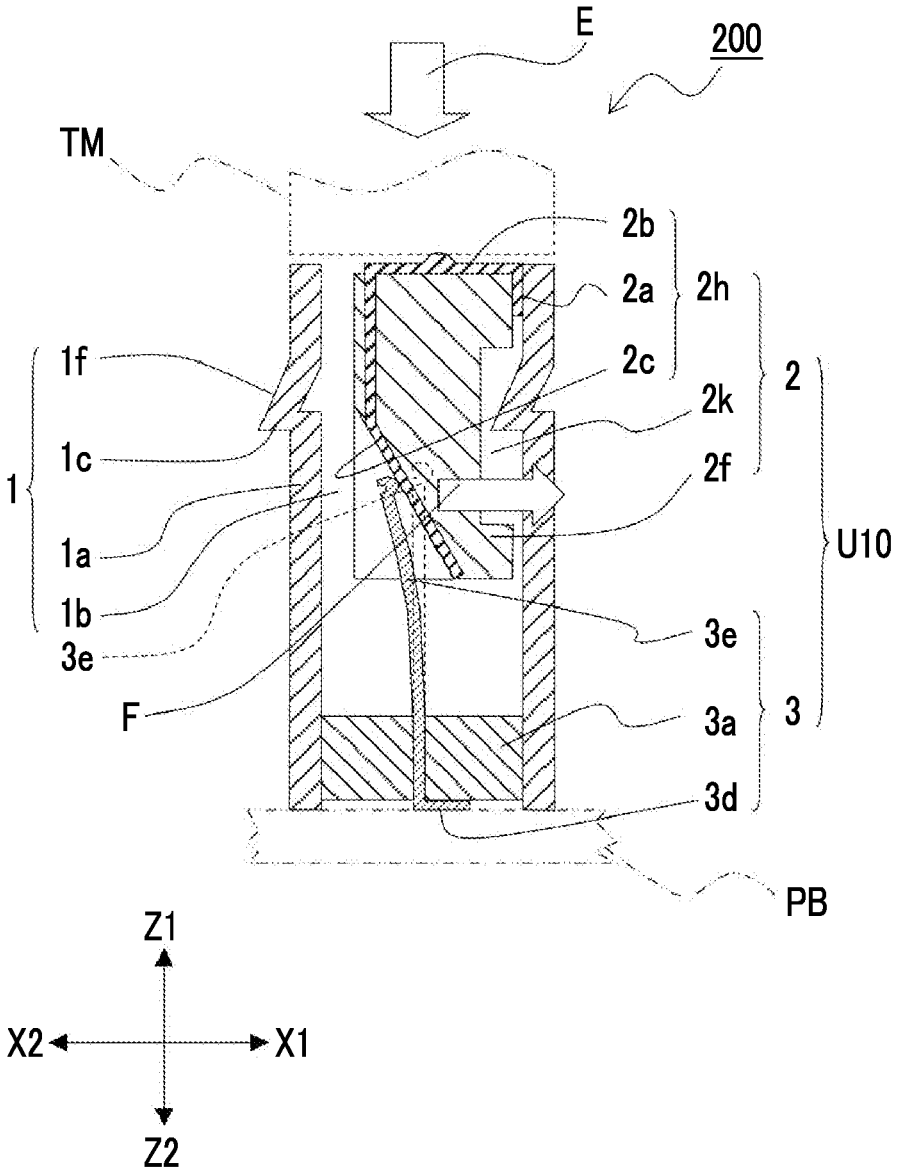
FIG. 10 is a schematic view for an operation explanation of the electronic component socket in an embodiment of the disclosure, and is a view showing a state where the socket is pressed downward from the state shown in FIG. 9.

FIG. 10 is a schematic view for an operation explanation of the electronic component socket 200 in an example embodiment, and is a view showing the state where the socket is pressed downward from the state shown in FIG. 9.

When the electronic component is not attached to the electronic component socket 200, as shown in FIG. 9, in the electronic component socket 200, the movement member 2 may be biased upward by the biasing portion 3*e* of the elastic member 3, the protrusion 1*c* and the concave portion 2*k* may engage with each other, and thus, the movement member 2 may be held without falling off of the opening portion 1*b*. If the electronic component is attached to the electronic component socket 200, as shown in FIG. 10, from the state shown in FIG. 9, first, the electrode terminal TM of the electronic component placed above the opening portion 1*b* and the contact portion 2*b* of the movement member 2 contact each other, and the electric connection between the electronic component and the electronic component socket 200 is realized. Thereafter, if the movement member 2 is pressed in a direction of an arrow E (Z2 direction), the biasing portion 3*e* is bent along the inclined surface portion 2*c*, and the electric connection between the electronic component and the electronic component socket 200 becomes more stable. At this time, according to the movement of the movement member 2, the force biased in the direction against the movement of the movement member 2 is applied from the biasing portion 3*e* to the inclined surface portion 2*c*. Accordingly, a component force in a direction perpendicular to the direction against the movement of the movement member 2 may be applied to the inclined surface portion 2*c*. As shown in FIG. 10, since the component force is operated in an arrow F direction (X1 direction), the movement member 2 moves in the direction in which the concave portion 2*k* is formed, and the grounded contact portion 2*a* and the inner circumferential surface of the shield body 1 contact each other. Accordingly, when the contact unit U10 is used for grounding, the grounded contact portion 2*a* is electrically connected to the inner circumferential surface of the shield body 1, and can be grounded. Moreover, coating, plating, or the like having insulation properties may be applied to the shield plate 1*a* at the location corresponding to the contact unit U10 which is not used for grounding, and thus, even when the grounded contact portion 2*a* of the contact unit U10 which is not used for grounding and the shield body 1 contact each other, the grounding is not realized. Moreover, when the contact unit U10 is used for grounding, although it is not shown, the contact portion 3*d* and the shield body 1 may be electrically connected to each other by, for example, a method such as connecting using a circuit or connecting using conductive adhesive or solder. In addition, the force may be operated in the direction of the arrow F, and thus, the concave portion 2*k* may be biased toward the protrusion 1*c*.

In the electronic component socket 200 according to an example embodiment may include: the shield body 1 which forms the opening portion 1*b* and has conductivity; the movement member 2 which may include the conductive member 2*h* having the contact portion 2*b* capable of contacting the electrode terminal TM of the electronic component placed above the opening portion 1*b*; and the elastic member 3 which may be electrically connectable to the wiring of the wiring substrate PB placed below the opening portion 1*b* and may include the biasing portion 3*e* having the biasing force and the base portion 3*a* fixing the biasing portion 3*e*, in which the movement member 2 may be disposed to move vertically above the elastic member 3 in the opening portion 1*b*, and the biasing portion 3*e* elastically contacts the movement member 2, the shield body 1 may include one protrusion 1*c* protruding toward the center side of the opening portion 1*b* in the opening portion 1*b*, the movement member 2 may include one concave portion 2*k* which engages with the protrusion 1*c*, the conductive member 2*h* may include one inclined surface portion 2*c* which may be formed on the rear side of the concave portion 2*k* and may extend so as to be close to the side, on which the concave portion 2*k* is provided, toward the lower portion, and the biasing portion 3*e* of the elastic member elastically contacts the inclined surface portion 2*c*.

Accordingly, since the protrusion 1*c* is more easily formed compared to a cut-and-raised portion, a reduction in the size can be easily achieved. In addition, the conductive member 2*h* included in the movement member 2 may include the inclined surface portion 2*c* which may be formed on the rear side of the concave portion 2*k* and extends so as to be close to the side on which the concave portion 2*k* is provided toward the lower portion, and the biasing portion 3*e* of the elastic member 3 elastically contacts the inclined surface portion 2*c* from the lower portion. Accordingly, the movement member 2 may be biased upward by the elastic force of the biasing portion 3*e*, and may be biased to the direction in which the protrusion 1*c* is provided. That is, the concave portion 2*k* may be pressed to the protrusion 1*c*, and thus, engagement between the protrusion 1*c* and the concave portion 2*k* is securely performed. Accordingly, the electronic component socket, in which the removal preventing structure can be processed without being limited by the size of the conductive member 2*h* and desired removal prevention strength can be obtained, can be provided.

In the electronic component socket 100 and the electronic component socket 200 described above, the shield body 1 may be formed of the plurality of metal plates, and the shield body 1 may be configured to be fixed and incorporated in the housing 4. Moreover, the protrusion 1*c* provided in the shield body 1 and the concave portion 2*k* provided in the movement member 2 engage with each other, and the movement member 2 may be configured to be prevented from falling off of the opening portion 1*b* of the shield body 1. In the electronic component socket 300 according to an example embodiment, the shield body may be integrally formed and may be configured of a resin molded piece to which metal plating is applied. In addition, a protrusion provided in a movement member and a concave portion provided in the shield body engage with each other, and the movement member may be configured to be prevented from falling off of the opening portion of the shield body. In below descriptions, the same constitution part names and portion names are used with respect to the constitution parts and portions having functions similar to the constitution parts and portions which are used in the electronic component socket 100 of the and the electronic component socket 200.

Figure 11A:
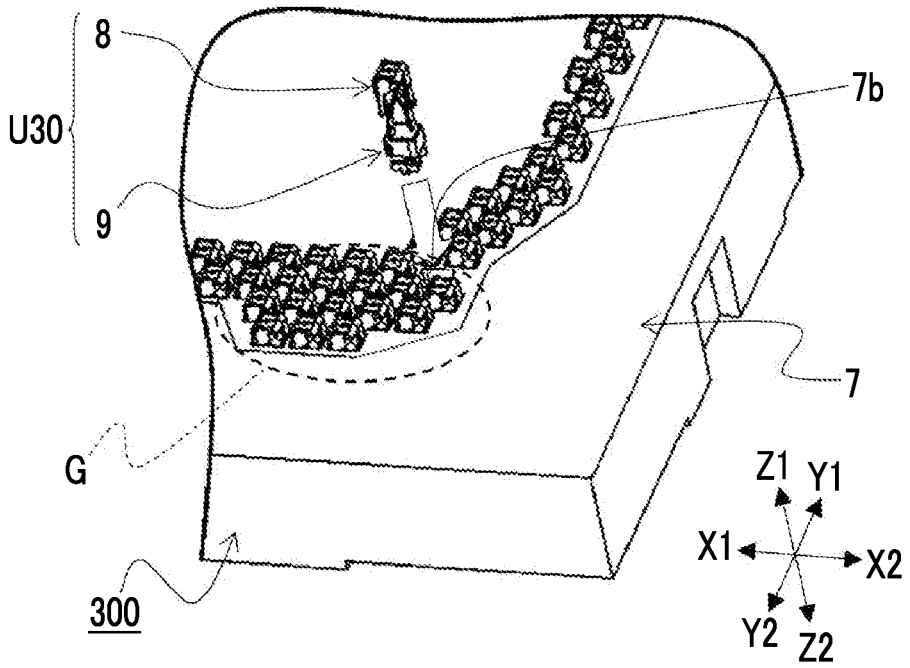
FIGS. 11A and 11B are views showing an electronic component socket in an embodiment of the disclosure.
Figure 11B:
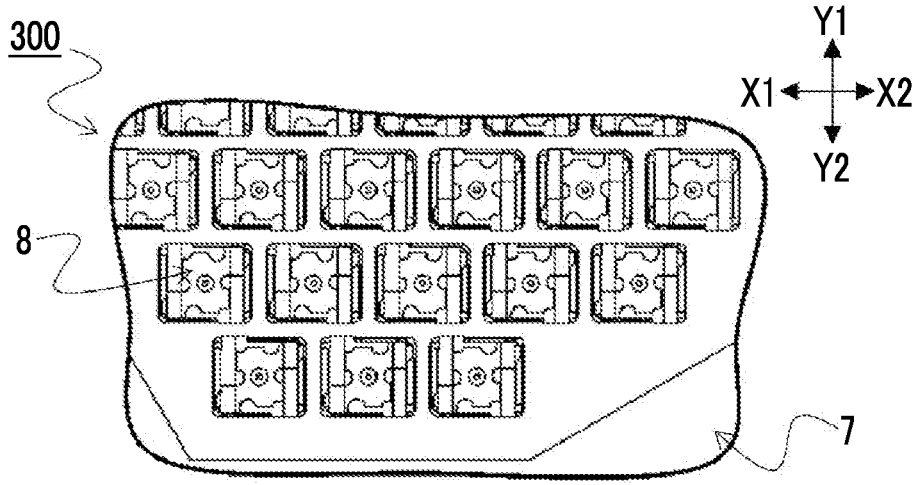
Figure 12A:
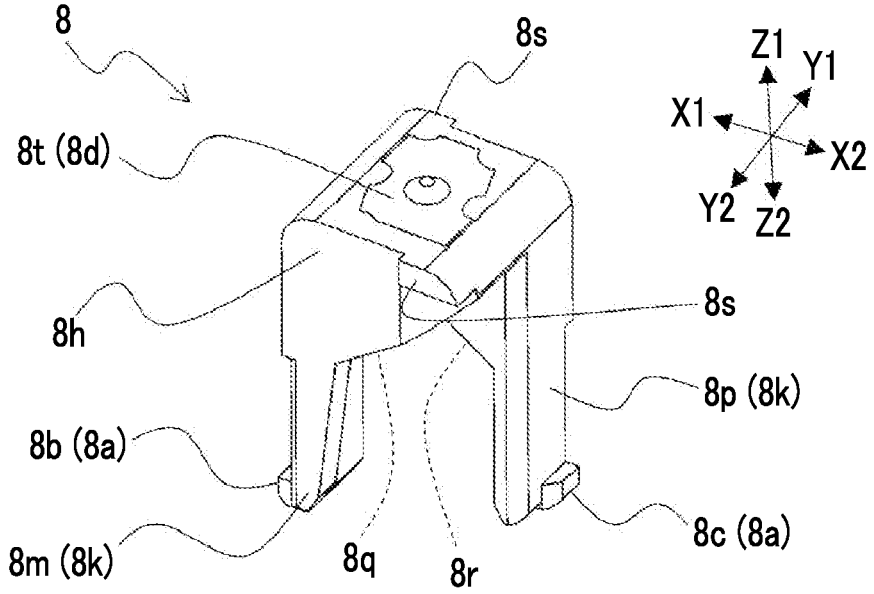
FIGS. 12A and 12B are views showing a movement member in an embodiment of the disclosure.
Figure 12B:
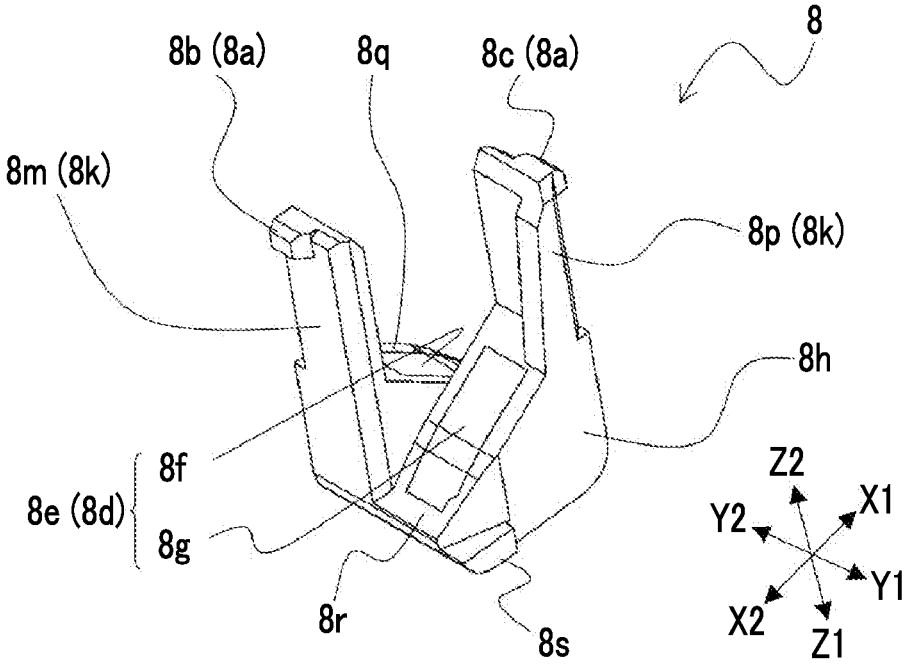
Figure 13A:
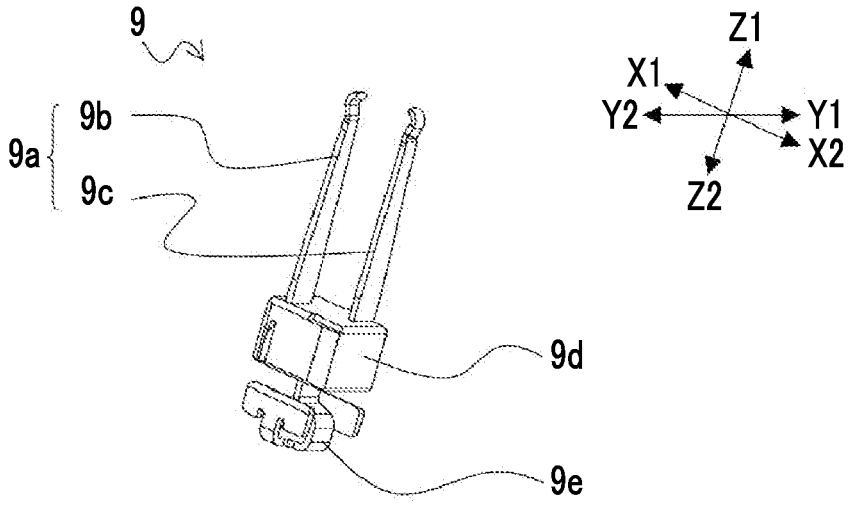
FIGS. 13A to 13C are views showing an elastic member in an embodiment of the disclosure.
Figure 13B:
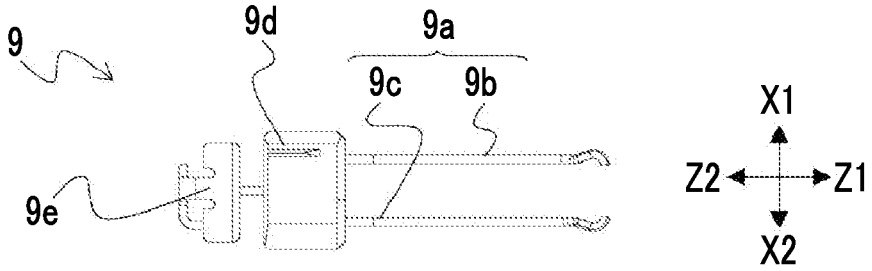
Figure 13C:
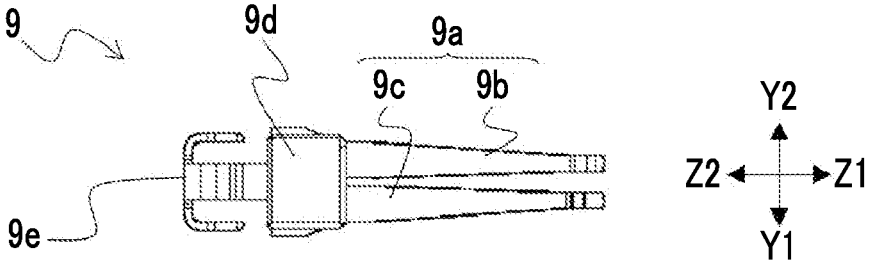
Figure 14A:
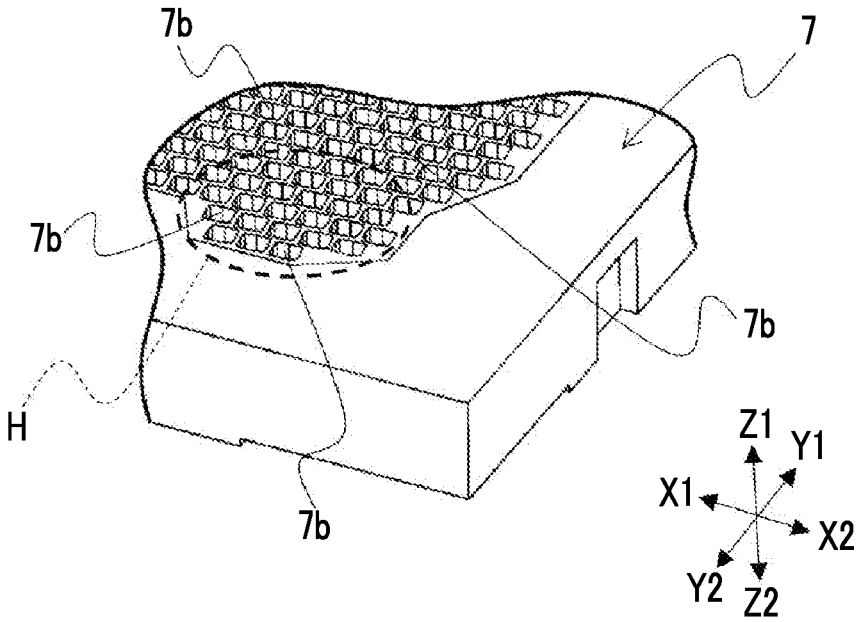
FIGS. 14A and 14B are views showing a portion of the shield body in an embodiment of the disclosure.
Figure 14B:
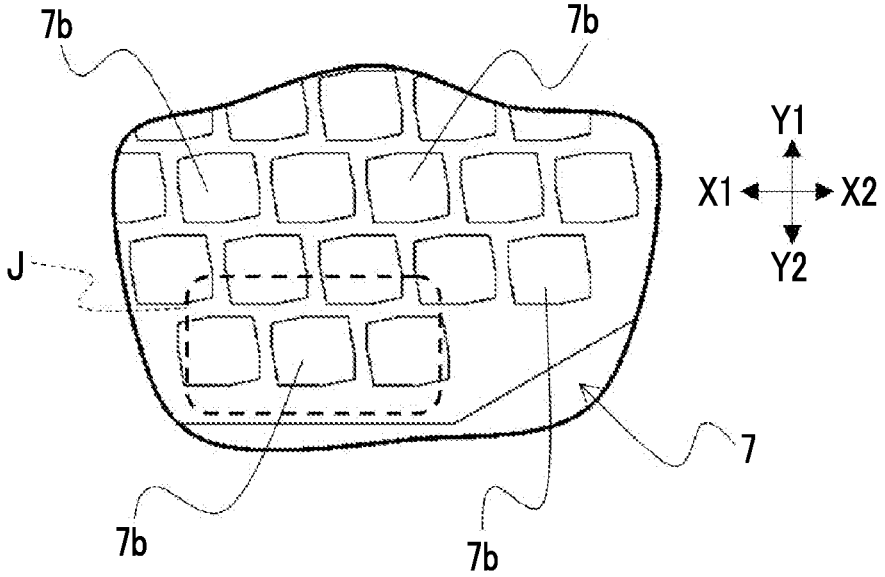
Figure 15A:
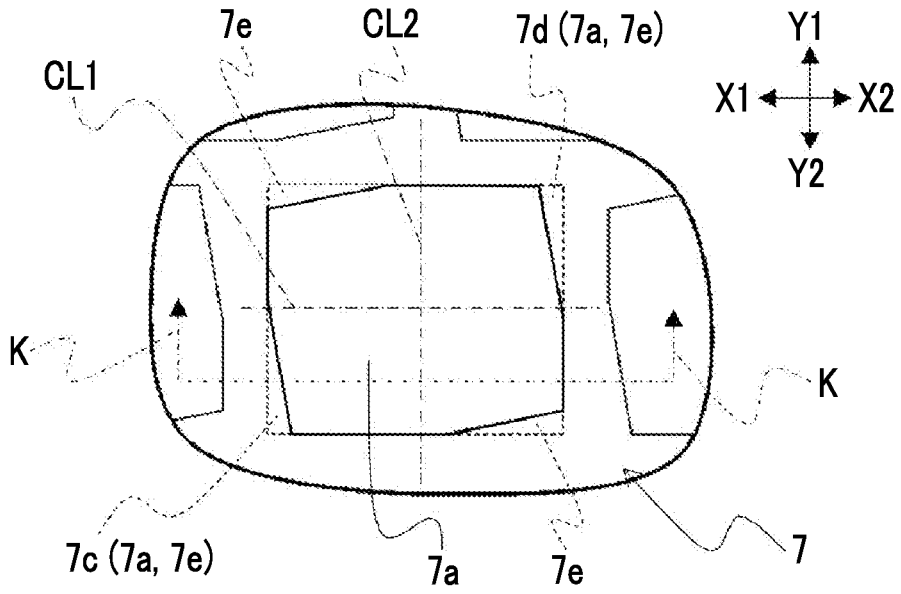
FIGS. 15A and 15B are enlarged views showing a J portion shown in FIGS. 14A and 14B.
Figure 15B:
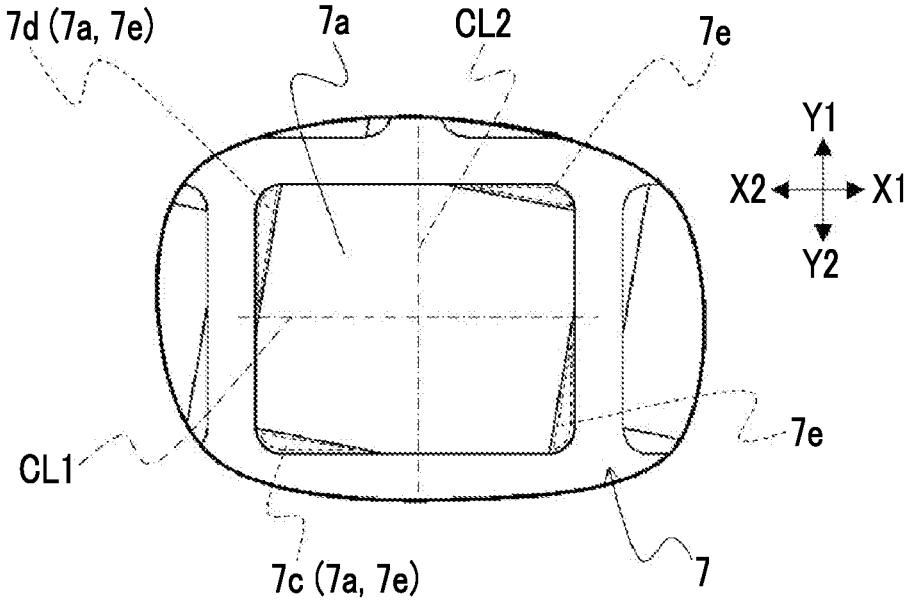
Figure 16:
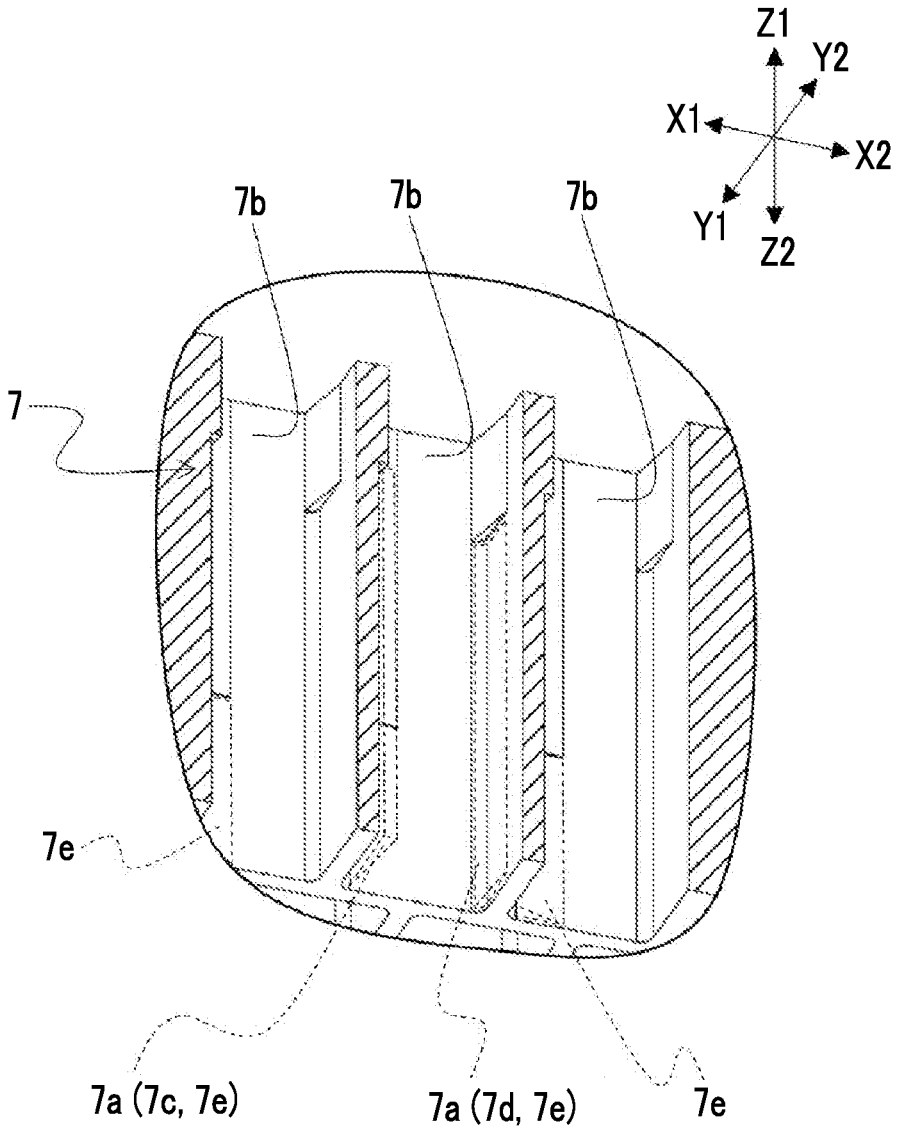
FIG. 16 is a perspective view showing a cross-section of the opening portion taken along cross-section line K-K shown in FIGS. 15A and 15B, from the Z2 direction side.

FIGS. 11A and 11B are views showing the electronic component socket 300, FIG. 11A is an enlarged perspective view showing an outline of the electronic component socket 300, and FIG. 11B is an enlarged plan view showing a G portion shown in FIG. 11A viewed from a Z1 direction side. Moreover, the shape of an opening portion 7*b* of a shield body 7 shown in FIGS. 11A and 11B is schematically shown to be different from the actual shape. FIGS. 12A and 12B are views showing a movement member 8, FIG. 12A is a perspective view showing an outline of the movement member 8, and FIG. 12B is a perspective view showing the movement member 8 viewed from a Z2 direction side shown in FIG. 12A. FIGS. 13A to 13C are views showing an elastic member 9, FIG. 13A is a perspective view showing an outline of the elastic member 9, FIG. 13B is a side view showing the elastic member 9 viewed from a Y2 direction side shown in FIG. 13A, and FIG. 13C is a side view showing the elastic member 9 viewed from an X2 direction side shown in FIG. 13A. FIGS. 14A and 14B are views showing a portion of the shield body 7, FIG. 14A is a perspective view showing a portion of the shield body 7, and FIG. 14B is an enlarged view showing an H portion shown in FIG. 14A viewed from the Z1 direction side. FIGS. 15A and 15B are enlarged views showing a J portion shown in FIGS. 14A and 14B, FIG. 15A is an enlarged view showing the J portion viewed from the Z1 direction, and FIG. 15B is an enlarged view showing the J portion viewed from the Z2 direction side. FIG. 16 is a perspective view showing a cross-section of the opening portion 7*b* taken along cross-section line K-K shown in FIGS. 15A and 15B, from the Z2 direction side.

As shown in FIGS. 11A and 11B, the electronic component socket 300 may include the shield body 7 which may be configured of one part, and contact units U30 which electrically connect electrode terminals TM (refer to FIG. 10) of electronic components and the wiring of the wiring substrate PB. As shown in FIGS. 11A and 11B, the contact unit U30 may include the movement member 8 and the elastic member 9.

As shown in FIGS. 12A and 12B, the movement member 8 may be formed in an approximately rectangular parallelepiped shape. The movement member 8 may include a seat portion 8*h* and a conductive member 8*d*. The seat portion 8*h* may be formed of a synthetic resin material and may be formed in an approximately rectangular parallelepiped shape. In addition, the seat portion 8*h* may include legs 8*k* which extend downward (Z2 direction) from the lower surface (the surface on the Z2 direction side). The legs 8*k* may include a first leg 8*m* which may be provided at a corner on the X1 direction side and the Y2 direction side, and a second leg 8*p* which may be provided at a corner on the X2 direction side and the Y1 direction side, and the corners may be positioned at a pair of diagonal positions on the lower surface of the seat portion 8*h*. Moreover, the movement member 8 may include protrusions 8*a* which protrude laterally from the tip portions of the legs 8*k*, and a corner of each of the legs 8*k* which continues from the corner of the seat portion 8*h* is formed to be chamfered. In addition, a first protrusion 8*b* which is the protrusion 8*a* provided on the first leg 8*m* may be formed on the X1 direction side, and a second protrusion 8*c* which is the protrusion 8*a* provided on the second leg 8*p* may be formed on the X2 direction side. In addition, an inclined location may be formed on the lower surface of the seat portion 8*h*. In the base of the first leg 8*m*, a first inclined surface 8*q* may be formed on the side opposite to the side on which the first protrusion 8*b* is provided, and the first inclined surface 8*q* may be gradually inclined to the side, on which the first leg 8*m* is provided, toward the lower portion. Moreover, in the base of the second leg 8*p*, a second inclined surface 8*r* may be formed on the side opposite to the side on which the second protrusion 8*c* is provided, and the second inclined surface 8*c* may be gradually inclined to the side, on which the second leg 8*p* is provided, toward the lower portion. In addition, stopper portions 8*s* laterally protruding may be provided at corners of the upper surface (the surface on the Z1 direction side) of the seat portion 8*h* corresponding to a pair of diagonal positions which is different from the pair of diagonal positions at which the legs 8*k* are provided. Each of the stopper portions 8*s* may be provided to protrude in a direction orthogonal to the direction in which the protrusion 8*a* protrudes. The stopper portion 8*s* provided at the corner on the X1 direction side and the Y1 direction side protrudes to the Y1 direction side, and the stopper portion 8*s* provided at the corner on the X2 direction side and the Y2 direction side protrudes to the Y2 direction side. Moreover, the conductive member 8*d* may be formed of a metal plate having conductivity, and may include a contact portion 8*t* which can contact the electrode terminal TM (refer to FIG. 17) of the electrode component, and an inclined surface portion 8*e* which may be electrically connected to the contact portion 8*t*. The contact portion 8*t* and the inclined surface portion 8*e* may be formed of one sheet of metal plate, and the contact portion 8*t* and the inclined surface portion 8*e* may be electrically connected to each other. The conductive member 8*d* may be integrally formed with the seat portion 8*h* by insertion molding, the contact portion 8*t* may be provided to be exposed to the upper surface of the seat portion 8*h*, and the inclined surface portion 8*e* may be formed to be exposed to the rear side of the protrusion 8*a* and may extend so as to be close to the side, on which the protrusion 8*a* is provided, toward the lower portion. A first inclined surface portion 8*f* may be formed on the rear side of the first protrusion 8*b* and may extend so as to be close to the side, on which the first protrusion 8*b* is provided, toward the lower portion, and the first inclined surface portion may be provided to be exposed along the first inclined surface 8*q* of the seat portion 8*h*. Similarly, a second inclined surface portion 8*g* may be formed on the rear side of the second protrusion 8*c* and may extend so as to be close to the side, on which the second protrusion 8*c* is provided, toward the lower portion, and the second inclined surface portion may be provided to be exposed along the second inclined surface 8*r* of the seat portion 8*h*.

As shown in FIGS. 13A to 13C, the elastic member 9 may include a biasing portion 9*a* which may be formed of a metal plate, and may have conductivity and a biasing force, and a base portion 9*d* which may be formed of a synthetic resin material, may be formed in a rectangular parallelepiped shape, and may fix the biasing portion 9*a*. The biasing portion 9*a* may include a first elastic contact portion 9*b* and a second elastic contact portion 9*c* which protrude upward from the upper surface (the surface on the Z1 side) of the base portion 9*d* and may be formed in cantilever spring shapes. The first elastic contact portion 9*b* and the second elastic contact portion 9*c* may be disposed at the pair of diagonal positions on the upper surface of the base portion 9*d*, the first elastic contact portion 9*b* may be disposed at the corner on the X1 direction side and the Y2 direction side, and the second elastic contact portion 9*c* may be disposed at the corner on the X2 direction side and the Y1 direction side. Moreover, in FIGS. 13A to 13C, the first elastic contact portion 9*b* and the second elastic contact portion 9*c* can be elastically deformed in the X1-X2 direction. In addition, the elastic member 9 may be formed of a metal plate, may be formed to protrude from the lower surface (the surface of the Z2 side) of the base portion 9*d*, and may include a contact portion 9*e* which can contact the wiring of the wiring substrate PB, and the biasing portion 9*a* is electrically connected to the contact portion 9*e*. Accordingly, the biasing portion 9*a* may be electrically connectable to the wiring of the wiring substrate PB which is placed below the opening portion 1*b*.

By disposing the movement member 8 to be overlapped on the upper portion of the elastic member 9 formed in this way, as shown in FIGS. 11A and 11B, the contact unit U30 is formed. In addition, in the movement member 8, the first elastic contact portion 9*b* elastically contacts the first inclined surface portion 8*f*, and the second elastic contact portion 9*c* elastically contacts the second inclined surface portion 8*g*.

The shield body 7 has conductivity, and as shown in FIGS. 14A and 14B, the plurality of opening portions 7*b* may be formed in hole shapes along the vertical direction (Z1-Z2 direction). In addition, the shield body 7 may be a resin molded piece which is formed of a synthetic resin material and is integrally formed to have one constitution part, and metal plating of a metal having conductivity is applied to the surface of the shield body. The opening portions 7*b* may be provided according to the dispositions of the electrode terminals TM of the corresponding electronic components. In addition, as shown in FIG. 15A, in the opening portion 7*b*, the opening shape when viewed from the upper portion (the Z1 direction side shown in FIGS. 14A and 14B) may be formed in an octagon in which right triangles having the same shapes are cut out from four rectangular corners. Moreover, as shown in FIG. 15B, in the opening portion 7*b*, the opening shape when viewed from the lower portion (the Z2 direction side shown in FIGS. 14A and 14B) may be formed in a rectangular shape. In this way, in the inner portion of the opening portion 7*b* which is formed so that the upper opening shape and the lower opening shape are different from each other, as shown in FIG. 16, grooves 7*e*, which are formed to be concave with respect to the upper side opening shape, are provided upward from the lower side end of the opening portion 7*b* at locations corresponding to four corners of the rectangular shape which is the lower side opening shape. Here, as shown in FIGS. 15A and 15B, a line bisecting the opening shape of the opening portion 7*b* is defined as a first center line CL1, and a line which is orthogonal to the first center line CL1 and bisects the opening shape of the opening portion 7*b* is defined as a second center line CL2. Moreover, in FIGS. 15A and 15B, the first center line CL1 is a line which bisects the opening shape of the opening portion 7*b* in the Y1-Y2 direction, and the second center line CL2 is a line which bisects the opening shape of the opening portion 7*b* in the X1-X2 direction. As shown in FIG. 16, in the groove 7*e* which may be provided on one side (Y2 direction side) with respect to the first center line CL1 and on one side (X1 direction side) with respect to the second center line CL2, and the groove 7*e* which may be provided on the other side (Y1 direction side) with respect to the first center line CL1 and on the other side (X2 direction side) with respect to the second center line CL2, the lengths of the two grooves 7*e* from the lower side end of the opening portion 7*b* may be longer and formed on a more upward side than grooves 7*e* provided at the other two locations. In this way, the groove 7*e* having a longer length from the end of the lower side of the opening portion 7*b* may be referred to as a concave portion 7*a*. Particularly, the concave portion 7*a* which is provided on one side with respect to the first center line CL1 and is provided on one side with respect to the second center line CL2 is referred to as a first concave portion 7*c*, and the concave portion 7*a* which is provided on the other side with respect to the first center line CL1 and on the other side with respect to the second center line CL2 is referred to as a second concave portion 7*d*. In this way, the shield body 7 may include the concave portion 7*a* including the first concave portion 7*c* and the second concave portion 7*d* in the opening portion 7*b*, and the concave portion 7*a* may be formed by resin forming. Moreover, the opening shape when the opening portion 7*b* is viewed from the upper portion may be formed to have a size into which the movement member 8 can be inserted, and the opening shape when the opening portion 7*b* is viewed from the lower portion may be formed to have a size into which the base portion 9*d* of the elastic member 9 can be inserted.

Figure 17:
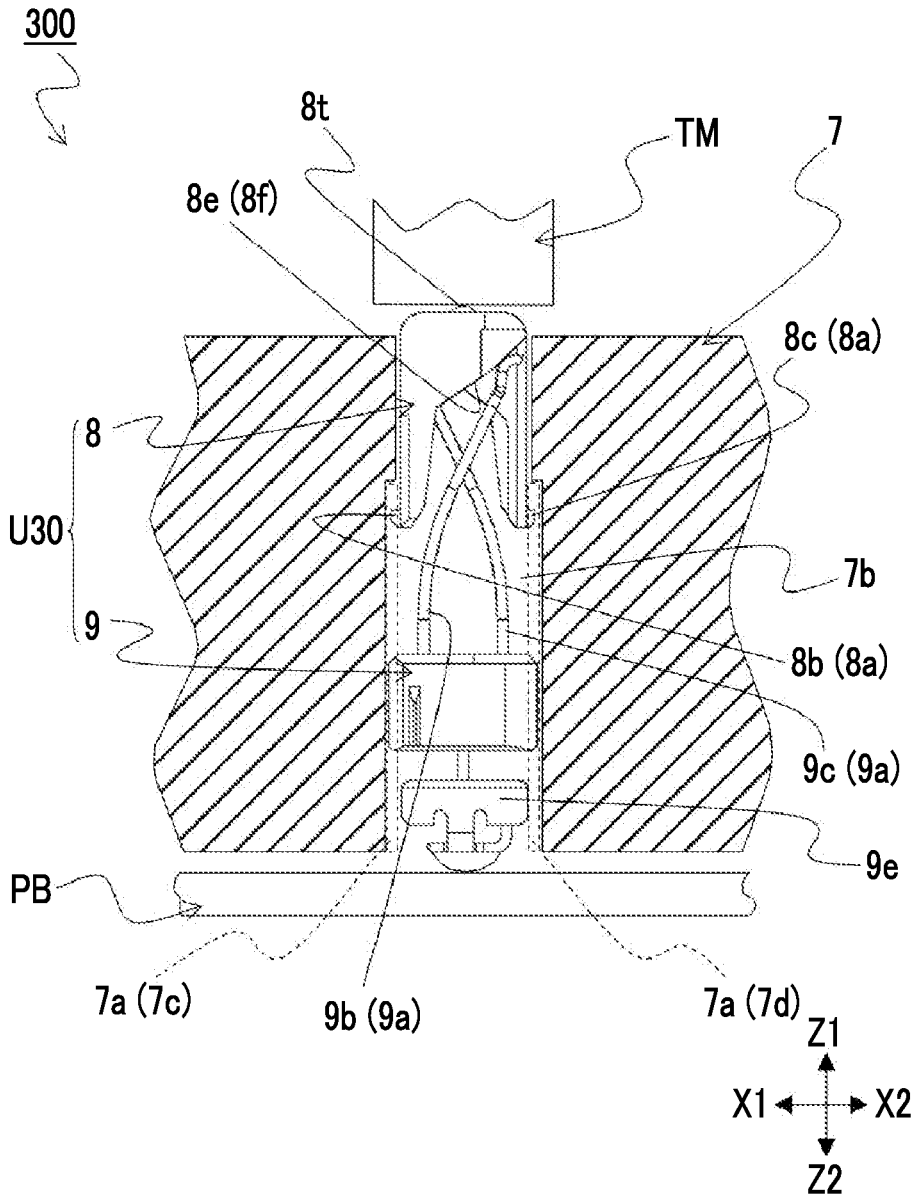
FIG. 17 is a schematic view showing a structure of the electronic component socket in an embodiment of the disclosure.
Figure 18:
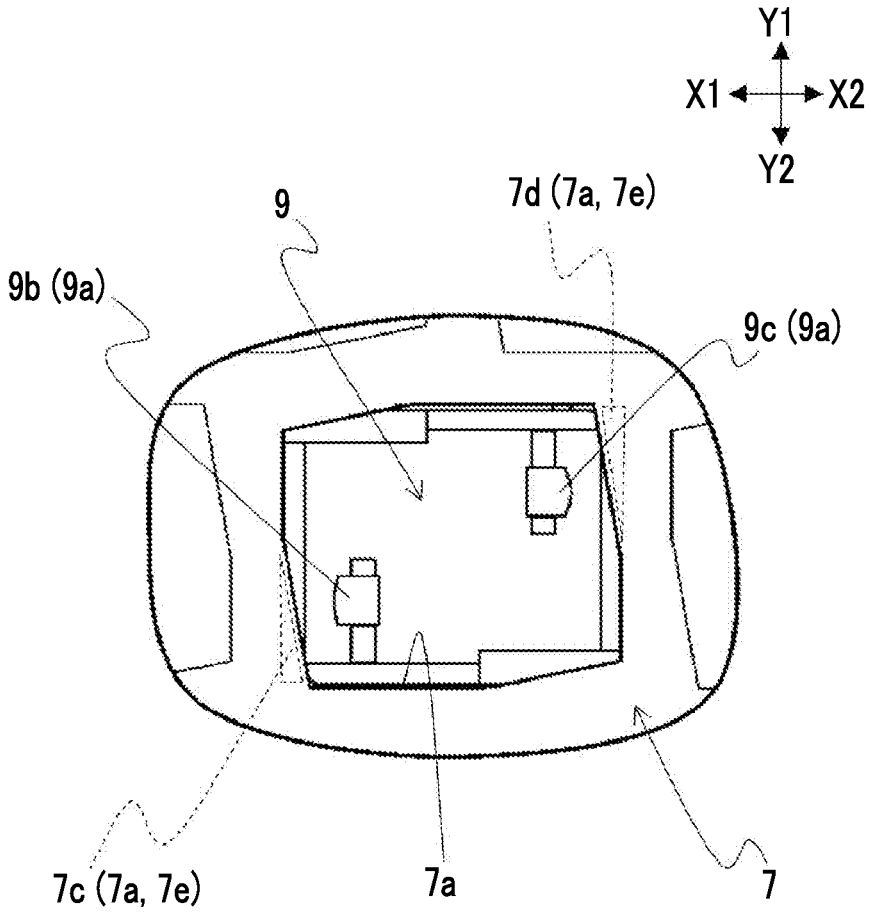
FIG. 18 is a plan view showing a state where the elastic member is disposed in the opening portion in an embodiment of the disclosure, from the Z1 direction side shown in FIGS. 11A and 11B.
Figure 19:
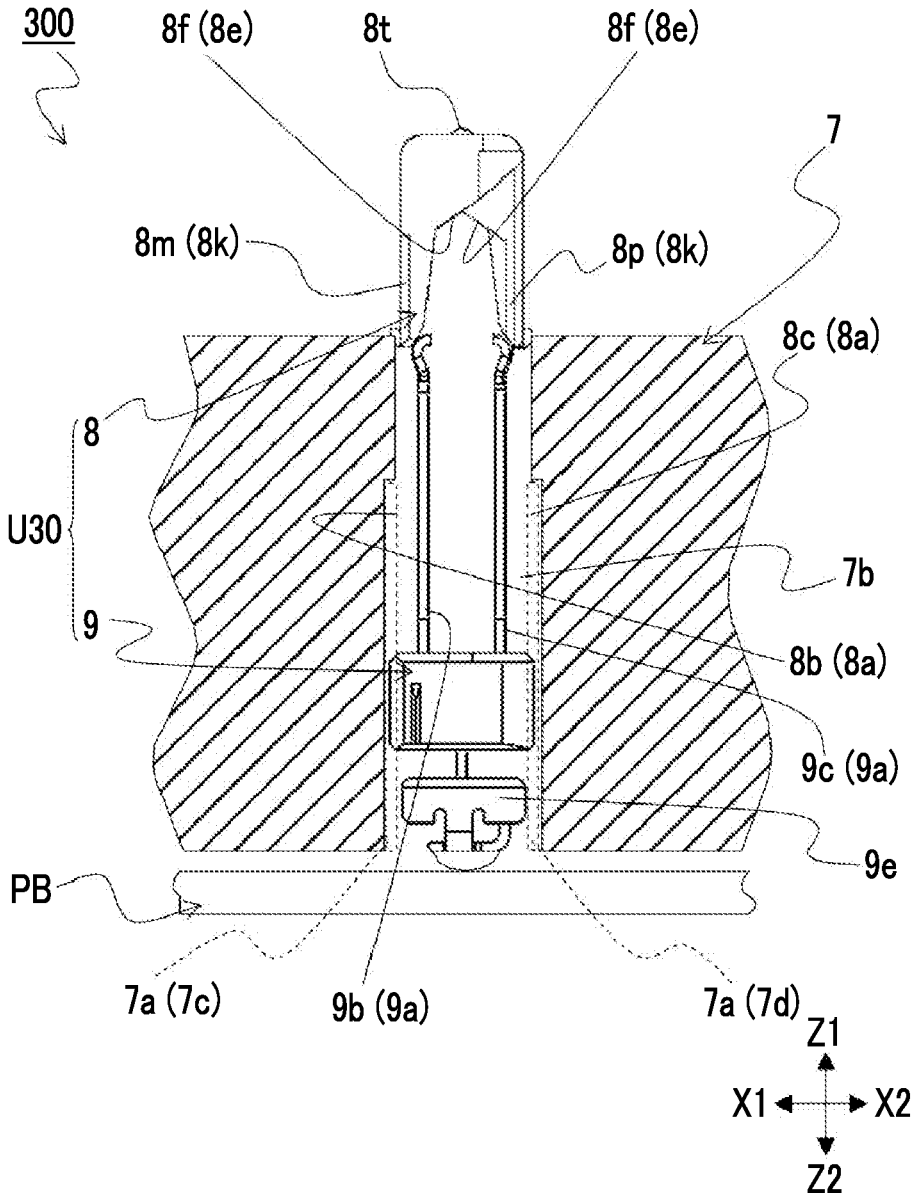
FIG. 19 is a schematic view showing a structure of the electronic component socket before the movement member in an example embodiment is incorporated.
Figure 20A:
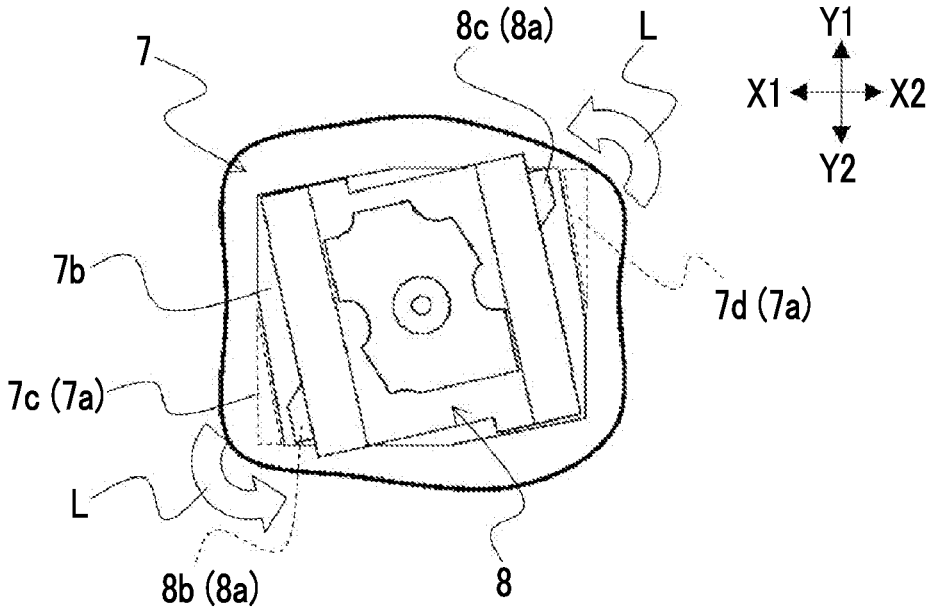
FIGS. 20A and 20B are views showing a method of inserting the movement member into the opening portion in the an example embodiment.
Figure 20B:
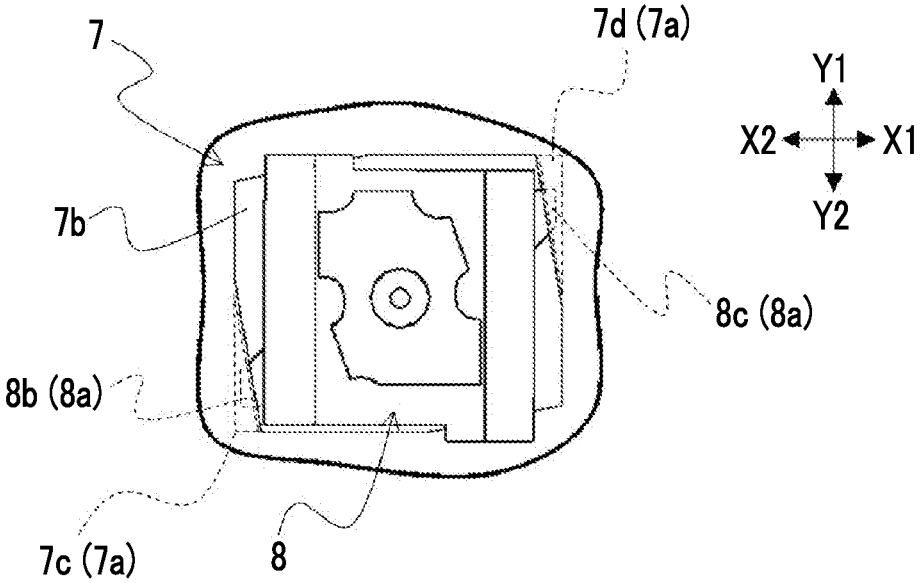
Figure 21:
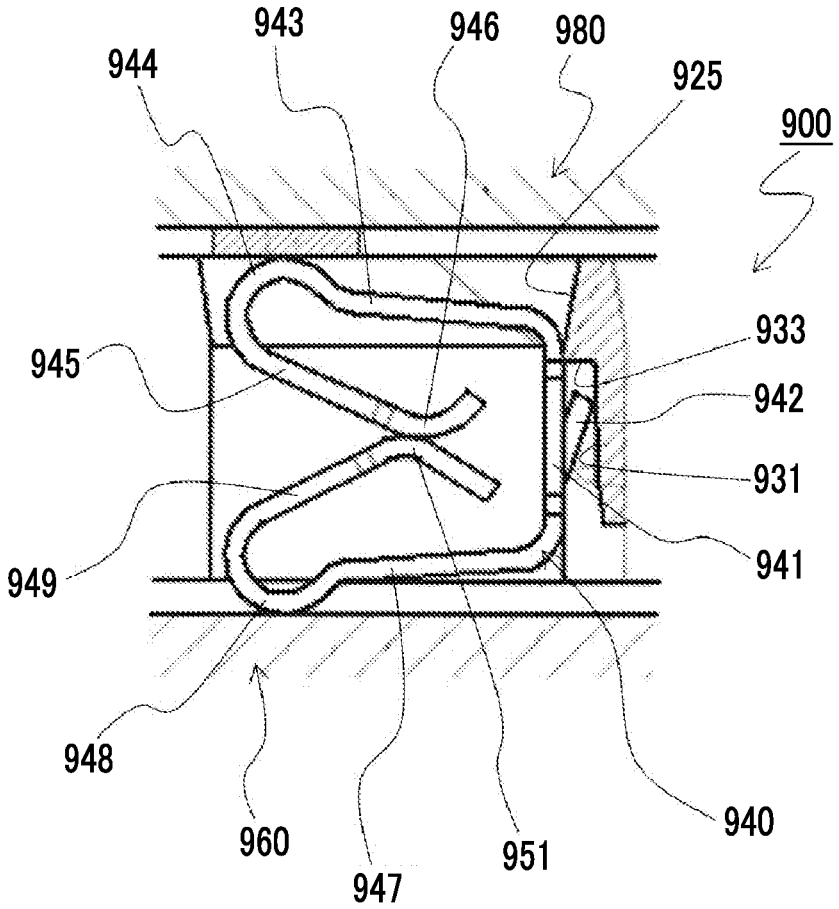
FIG. 21 is a cross-sectional view showing a structure of a prior art connector included in an electronic component socket disclosed in Japanese Unexamined Patent Application Publication No. 2008-021639.

FIG. 17 is a schematic view showing the structure of the electronic component socket 300. Moreover, FIG. 17 shows a state where the socket is disposed on a wiring substrate PB and contacts an electrode terminal TM of the electronic component. FIG. 18 is a plan view showing the state where the elastic member 9 is disposed in the opening portion 7*b*, from the Z1 direction side shown in FIGS. 11A and 11B. FIG. 19 is a schematic view showing the structure of the electronic component socket 300 before the movement member 8 is incorporated. FIGS. 20A and 20B are views showing a method of inserting the movement member 8 into the opening portion 7*b*, FIG. 20A is a plan view showing a direction of the movement member 8 when the movement member 8 is inserted into the opening portion 7*b*, and FIG. 20B is a plan view showing the direction of the movement member 8 after the movement member 8 is inserted into the opening portion 7*b*.

As shown in FIG. 17, the electronic component socket 300 may be formed so that the contact unit U30 is disposed in the inner portion of each opening portion 7*b* of the shield body 7.

The elastic member 9, which may be disposed in the inner portion of the opening portion 7*b* of the shield body 7, is formed so that the biasing portion 9*a* protrudes to the upper portion. Moreover, as shown in FIG. 18, the elastic member 9 may be accommodated in the inner portion of the opening portion 7*b* so that the first elastic contact portion 9*b* which is one biasing portion 9*a* is disposed in the vicinity of the corner of the opening portion 7*b* in which the first concave portion 7*c* is provided, and the second elastic contact portion 9*c* which is the other biasing portion 9*a* may be disposed in the vicinity of the corner of the opening portion 7*b* in which the second concave portion 7*d* is provided.

In addition, as shown in FIG. 19, the movement member 8 may be inserted from the upper side (Z1 direction side) opening of the opening portion 7*b* into the inner portion of the opening portion 7*b* so that the first leg 8*m* and the first elastic contact portion 9*b* contact each other, and the second leg 8*p* and the second elastic contact portion 9*c* contact each other. At this time, as shown in FIGS. 20A and 20B, in a plan view, the first protrusion 8*b* may protrude toward the first concave portion 7*c* of the shield body 7 which is provided on one side (Y2 direction side) with respect to the first center line CL1 (refer to FIGS. 15A and 15B) bisecting the opening end portion of the opening portion 7*b* and on one side (X1 direction side) with respect to the second center line CL2 (refer to FIGS. 15A and 15B) orthogonal to the first center line CL1. In addition, the second protrusion 8*c* may be provided on the other side (Y1 direction side) with respect to the first center line CL1 and on the other side (X2 direction side) with respect to the second center line CL2, and may protrude to a direction opposite to the protrusion direction of the first protrusion 8*b*. As shown in FIG. 19, in the movement member 8, the biasing portions 9*a* elastically contact the rear side surfaces of the surfaces on which the protrusions 8*a* of the legs 8*k* are provided, and the biasing portions 9*a* may be inserted into the opening portion 7*b* while being bent. Moreover, when the movement member 8 is inserted into the opening portion 7*b* from the upper side opening, as shown in FIG. 20A, the protrusion 8*a* may be inserted in a state where the movement member 8 is rotated in a direction (an arrow L direction) separated from the concave portion 7*a*, and thus, the movement member 8 can be inserted while the protrusion 8*a* does not contact the shield body 7. In addition, in FIG. 20A, it is seen that a portion (leg 8*k*) of the movement member 8 contacts the shield body 7. However, as shown in FIGS. 12A and 12B, since the chamfering is performed on the location that seems to be in contact with the shield body 7, the movement member 8 does not contact the shield body 7. In this way, if the movement member 8 is inserted into the opening portion 7*b*, the biasing portion 9*a* may bias the movement member 8 to the upper portion and may bias the movement member to be rotated in a direction opposite to the arrow L. Specifically, as shown in FIG. 17, the first elastic contact portion 9*b* may bias the first inclined surface portion 8*f* in the X1 direction, and the second elastic contact portion 9*c* may bias the second inclined surface portion 8*g* in the X2 direction. In this way, the movement member 8 may be biased to be rotated in the direction opposite to the arrow L, and thus, as shown in FIG. 20B, the protrusion 8*a* and the concave portion 7*a*, which may be disposed so that the first protrusion 8*b* faces the first concave portion 7*c* and the second protrusion 8*c* faces the second concave portion 7*d*, engage with each other so that the protrusion 8*a* rotates in a certain direction of the concave portion 7*a* and the protrusion 8*a* contacts the upper end side surface of the concave portion 7*a*. In addition, in FIG. 17, the movement member 8 may contact the electrode terminal TM of the electronic device. However, since the movement member 8 is pressed downward against the biasing force of the elastic member 9, the protrusion 8*a* may be separated from the upper end side surface of the concave portion 7*a*. The protrusion 8*a* and the concave portion 7*a* may engage with each other, and thus, the movement member 8 may be disposed above the elastic member 9 to be vertically movable without falling out of the opening portion 7*b* in the state where the contact portion 8*t* is exposed from the upper side (Z1 direction side) opening of the opening portion 7*b*, and the contact unit U30 is formed. In addition, at the time, the biasing portion 9*a* of the elastic member 9 elastically contacts the inclined surface portion 8*e* of the movement member 8. That is, the first elastic contact portion 9*b* and the first inclined surface portion 8*f* elastically contact each other, and the second elastic contact portion 9*c* and the second inclined surface portion 8*g* elastically contact each other. In this way, the biasing portion 9*a* of the elastic member 9 elastically may contact the inclined surface portion 8*e* of the movement member 8, and thus, the contact portion 8*t* of the elastic member 9 and the contact portion 9*e* of the movement member 8 may be electrically connected to each other. Accordingly, the electronic component socket 300 is formed.

As shown in FIG. 17, the electronic component socket 300 may be disposed above the wiring substrate PB, the electrode terminal TM of the corresponding electronic device may be disposed on the upper portion of the socket, and thus, the socket may be used to electrically connect the wiring substrate PB and the electronic device. If the electronic component socket 300 is disposed on the wiring substrate PB, the contact portion 9*e* may contact the wiring of the wiring substrate PB which may be disposed below the opening portion 7*b* and may be electrically connected to the wiring. Accordingly, the wiring substrate PB and the electronic component socket 300 may be electrically connected to each other. In a state where the electrode terminal TM of the electronic device is not disposed above the electronic component socket 300, the movement member 8 may be positioned higher (Z1 direction side) than the state shown in FIG. 17, and the protrusion 8*a* may be supported to contact the end surface on the upper side of the concave portion 7*a*. If the electrode terminal TM of the electronic device is disposed above the electronic component socket 300, as shown in FIG. 17, the movement member 8 may be pressed downward (Z2 direction) by the electrode terminal TM of the electronic device, and thus, the biasing portions 9*a* of the elastic member 9 move downward while being bent. At this time, the biasing portions 9*a* slide along the inclined surface portions 8*e* while being bent, and thus, an electric connection between the conductive member 8*d* and the elastic member 9 may be maintained. In addition, the contact portion 8*t* of the conductive member 8*d* contacts the electrode terminal TM of the electronic component placed above the opening portion 7*b*, and thus, the electronic device and the electronic component socket 300 are electrically connected to each other. Accordingly, the wiring substrate PB and the electronic device may be electrically connected to each other via the electronic component socket 300. In addition, if the movement member 8 is pressed downward, the stopper portions 8*s* (refer to FIGS. 12A and 12B) may contact the upper surface of the shield body 7, and thus, the movement member 8 may be prevented from being inserted into the opening portion 7*b* more than necessary. Moreover, when the opening portion 7*b* is viewed from the lower surface side (Z2 direction side) (refer to FIGS. 15A and 15B), the stopper portions 8*s* contact the upper surface of the shield body 7 corresponding to the grooves 7*e* (refer to FIGS. 15A and 15B) on which the concave portions 7*a* are not provided in the opening shape of the opening portion 7*b*.

Electronic component socket 300 may include: the shield body 7 which forms the opening portion 7*b* and has conductivity; the movement member 8 which may include the conductive member 8*d* having the contact portion 8*t* capable of contacting the electrode terminal TM of the electronic component placed above the opening portion 7*b*; the elastic member 9 which may be electrically connectable to the wiring of the wiring substrate PB placed below the opening portion 7*b* and may include the biasing portion 9*a* having the biasing force and the base portion 9*d* fixing the biasing portion 9*a*, in which the movement member 8 is disposed to move vertically above the elastic member 9 in the opening portion 7*b*, and the biasing portion 9*a* elastically contacts the movement member 8, the movement member 8 may include the protrusion 8*a* protruding toward the shield body 7, the shield body 7 may include the concave portion 7*a* in which the protrusion 8*a* engages with the inner portion of the opening portion 7*b*, the conductive member 8*d* may include the inclined surface portion 8*e* which may be formed on the rear side of the protrusion 8*a* and extends so as to be close to the side, on which the protrusion 8*a* is provided, toward the lower portion, and the biasing portion 9*a* of the elastic member 9 elastically contacts the inclined surface portion 8*e*.

Accordingly, since the protrusion 8*a* is more easily formed compared to the cut-and-raised portion, a reduction in the size can be easily achieved. In addition, the conductive member 8*d* included in the movement member 8 may include the inclined surface portion 8*e* which may be formed on the rear side of the protrusion 8*a* and extends so as to be close to the side on which the protrusion 8*a* is provided toward the lower portion, and the biasing portion 9*a* of the elastic member 9 elastically contacts the inclined surface portion 8*e* from the lower portion. Accordingly, the movement member 8 may be biased upward by the elastic force of the biasing portion 9*a*, and may be biased to the direction in which the concave portion 7*a* is provided. That is, the protrusion 8*a* may be pressed to the concave portion 7*a*, and thus, engagement between the protrusion 8*a* and the concave portion 7*a* is securely performed. Accordingly, the electronic component socket, in which the removal preventing structure can be processed without being limited by the size of the conductive member 8*d* and desired removal prevention strength can be obtained, can be provided.

In the electronic component socket 300, the shield body 7 may be integrally formed and may be formed of a resin molded piece to which the metal plating is applied, and the concave portion 7*a* may be formed by molding.

Accordingly, the shield body 7 may be formed of the resin molded piece which is integrally formed, and thus, compared to when a plurality of parts are formed to be combined, assembly is easily performed. In addition, when metal plating is applied to the surface, it is not necessary to apply the metal plating to each of the plurality of parts, and thus, frequency of the plating can be decreased. In addition, there is an advantageous effect in that the formation of the concave portion 7*a* can be easily performed by a molding die.

Moreover, in the electronic component socket 300, the movement member 8 may include: the first protrusion 8*b* which may be provided on one side with respect to the first center line CL1 bisecting the opening end portion of the opening portion 7*b* in a plan view and on one side with respect to the second center line CL2 orthogonal to the first center line CL1, and protrudes toward the shield body 7; and the second protrusion 8*c* which may be provided on the other side with respect to the first center line CL1 and on the other side with respect to the second center line CL2, and may protrude in the direction opposite to the protrusion direction of the first protrusion 8*b*, the shield body 7 may include: the first concave portion 7*c* which may be provided on one side with respect to the first center line CL1 and on one side with respect to the second center line CL2, and may engage with the first protrusion 8*b*; and the second concave portion 7*d* which may be provided on the other side with respect to the first center line CL1 and on the other side with respect to the second center line CL2, and may engage with the second protrusion 8*c*, the inclined surface portion 8*e* of the conductive member 8*d* may include: the first inclined surface portion 8*f* which may be formed on the rear side of the first protrusion 8*b* and extends so as to be close to the side, on which the first protrusion 8*b* is provided, toward the lower portion; and the second inclined surface portion 8*g* which may be formed on the rear side of the second protrusion 8*c* and extends so as to be close to the side, on which the second protrusion 8*c* is provided, toward the lower portion, and the biasing portion 9*a* of the elastic member 9 includes the first elastic contact portion 9*b* which elastically contacts the first inclined surface portion 8*f*, and the second elastic contact portion 9*c* which elastically contacts the second inclined surface portion 8*g*.

Accordingly, the conductive member 8*d* included in the movement member 8 may include the inclined surface portion 8*e* which is formed on the rear side of the protrusion 8*a* and extends so as to be close to the side on which the protrusion 8*a* is provided toward the lower portion, and the biasing portion 9*a* of the elastic member 9 elastically contacts the inclined surface portion 8*e* from the lower portion. Therefore, the movement member 8 may be biased upward by the elastic force of the biasing portion 9*a*, and may be biased to the direction in which the concave portion 7*a* is provided. That is, the protrusion 8*a* may be pressed to the concave portion 7*a*, and thus, engagement between the protrusion 8*a* and the concave portion 7*a* is securely performed. Accordingly, the electronic component socket, in which the removal preventing structure can be processed without being limited by the size of the conductive member 8*d* and desired removal prevention strength can be obtained, can be provided.

In addition, in the electronic component socket 300, the shield body 7 may be formed of a metal plate, and the concave portion 7*a* may be formed by performing protrusion-processing on the metal plate.

Accordingly, since the shield body 7 may be formed of a metal plate, compared to the case where, for example, the shield body is formed of a plate-shaped member of a synthetic resin material and is subjected to the processing for providing conductivity, the shield body can be easily formed. Moreover, since the concave portion 7*a* may be formed by the protrusion-processing, compared to the cut-and-raised portion, there is an advantageous effect in that the reduction in the size can be easily achieved, damage does not easily occur, and yield can be improved.

In addition, in the electronic component socket 300, when the opening portion 7*b* is viewed from the lower surface side (Z2 direction side) (refer to FIGS. 15A and 15B), the stopper portion 8*s* contacts the upper surface of the shield body 7 corresponding to the groove 7*e* on which the concave portion 7*a* is not provided in the opening shape of the opening portion 7*b*. Accordingly, even when the protrusion amount of the stopper portion 8*s* from the opening shape of the opening portion 7*b* is small, the stopper portion 8*s* can contact the upper surface of the shield body 7, a pitch by which the opening portions 7*b* are disposed is decreased, and thus, the electrode terminal TM can correspond to an electronic component having a narrower pitch.

As in the above, the sockets for electronic component according to example embodiments of the present disclosure are specifically described. However, the present disclosure is not limited to the above-described embodiments, and various modifications can be performed within a scope which does not depart from the spirit of the present disclosure. For example, the following modifications can be performed, and the modifications are also included in a technical range of the present invention.

In various embodiments, the protrusion 1*c* having a convex shape is provided on the shield body 1, the concave portion 2*k* having a concave shape is provided on the movement member 2, and the protrusion 1*c* and the concave portion 2*k* engage with each other. Accordingly, the concave portion 2*k* moves in the direction approaching the protrusion 1*c* according to the movement of the movement member 2, and thus, the engagement between the protrusion 1*c* and the concave portion 2*k* is securely performed. However, a portion having a concave shape is provided on the shield body 1, a portion having a convex shape is provided on the movement member 2, and the portion having the concave shape provided on the shield body 1 and the portion having the convex shape provided on the movement member 2 may engage with each other.

Accordingly, the electronic component socket, in which the removal preventing structure can be processed without being limited by the size of the conductive member and desired removal prevention strength can be obtained, can be provided. In various embodiments, the shield body 1 has the structure in which the rectangular opening portions 1*b* are disposed to be arranged in a matrix shape in a plan view. However, the shield body may have a structure, in which the opening portions are deviated half for each row, instead of being disposed in matrix shape, such as a honeycomb structure.

In an example embodiment, the inclined surface portion 2*c* of the movement member 2 is biased by one biasing portion 3*e* which is disposed in the vicinity of the center of the base portion 3*a*. However, the inclined surface portion 2*c* of the movement member 2 may be biased in the same direction by a plurality of biasing portions 3*e* which are arranged in parallel. According to this configuration, even when the abutment position between the biasing portion 3*e* and the inclined surface portion 2*c* is slightly deviated, the movement member 2 is not easily inclined, and thus, the concave portion 2*k* can be more securely pressed to the protrusion 1*c*, and the falling-out of the movement member 2 can be more securely prevented.

In various embodiments, the concave portion 2*k* is formed as a through hole. However, the concave portion 2*k* may not be penetrated and may be formed in a concave shape. In addition, the concave shape may be a step shape which does not have right and left walls and is opened.

Also, the shield body 1 is formed of a metal plate. However, the shield body 1 may be integrally formed and be formed of a resin molded piece to which metal plating is applied, and the protrusion 1*c* may be formed by molding. The shield body 1 is formed of the resin molded piece which is integrally formed, and thus, compared to when a plurality of parts are formed to be combined, assembly is easily performed. In addition, when metal plating is applied to the surface, it is not necessary to apply the metal plating to each of the plurality of parts, and thus, frequency of the plating can be decreased. Moreover, the formation of the protrusion 1*c* can be easily performed by a molding die. In addition, it is not necessary to combine a plurality of parts, and thus, a disadvantage such as damage due to an assembly mistake does not easily occur.

It should be understood by those skilled in the art that various modifications, combinations, sub-combinations and alterations may occur depending on design requirements and other factors insofar as they are within the scope of the appended claims of the equivalents thereof.

Accordingly, the embodiments of the present inventions are not to be limited in scope by the specific embodiments described herein. Further, although some of the embodiments of the present disclosure have been described herein in the context of a particular implementation in a particular environment for a particular purpose, those of ordinary skill in the art should recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein. While the foregoing description includes many details and specificities, it is to be understood that these have been included for purposes of explanation only, and are not to be interpreted as limitations of the invention. Many modifications to the embodiments described above can be made without departing from the spirit and scope of the invention.

What is claimed is:

1. An electronic component socket, comprising:

a shield body configured to form an opening portion and have conductivity;

a movement member which includes a conductive member having a contact portion capable of contacting an electrode terminal of an electronic component placed above the opening portion; and an elastic member which is configured to be electrically connectable to a wiring of a wiring substrate placed below the opening portion and includes a biasing portion having a biasing force and a base portion fixing the biasing portion, wherein the movement member is disposed to move vertically above the elastic member in the opening portion, and the biasing portion elastically contacts the movement member, wherein the shield body includes a protrusion protruding toward a center of the opening portion in the opening portion, wherein the movement member includes a concave portion which engages with the protrusion, wherein the conductive member includes an inclined surface portion which is formed on an opposite side of the concave portion and extends so as to be close to a side, on which the concave portion is provided, as extending toward a lower side, and wherein the biasing portion of the elastic member elastically contacts the inclined surface portion.

2. The electronic component socket according to claim 1, wherein the shield body is formed of a metal plate, and the protrusion is formed by protrusion-processing the metal plate.

3. The electronic component socket according to claim 1, wherein the shield body is integrally formed and is formed of a resin molded piece to which metal plating is applied, and the protrusion is formed by molding.

4. The electronic component socket according to claim 1, wherein the shield body includes: a first protrusion which is provided on one side with respect to a first center line bisecting an opening end portion of the opening portion in a plan view and on one side with respect to a second center line orthogonal to the first center line, and protrudes in a center direction of the opening portion; and a second protrusion which is provided on the other side with respect to the first center line and on the other side with respect to the second center line, and protrudes in a direction opposite to the protrusion direction of the first protrusion, wherein the movement member includes: a first concave portion which is provided on one side with respect to the first center line and on one side with respect to the second center line, and engages with the first protrusion; and a second concave portion which is provided on the other side with respect to the first center line and on the other side with respect to the second center line, and engages with the second protrusion, wherein the inclined surface portion of the conductive member includes: a first inclined surface portion which is formed on a rear side of the first concave portion and extends so as to be close to the side, on which the first concave portion is provided, toward a lower side; and a second inclined surface portion which is formed on a rear side of the second concave portion and extends so as to be close to the side, on which the second concave portion is provided, toward a lower side, and wherein the biasing portion of the elastic member includes a first elastic contact portion which elastically contacts the first inclined surface portion, and a second elastic contact portion which elastically contacts the second inclined surface portion.

5. An electronic component socket, comprising:

a shield body configured to form an opening portion and have conductivity;

a movement member which includes a conductive member having a contact portion capable of contacting an electrode terminal of an electronic component placed above the opening portion; and an elastic member which is configured to be electrically connectable to a wiring of a wiring substrate placed below the opening portion and includes a biasing portion having a biasing force and a base portion fixing the biasing portion, wherein the movement member is disposed to move vertically above the elastic member in the opening portion, and the biasing portion elastically contacts the movement member, wherein the movement member includes a protrusion protruding toward the shield body, wherein the shield body includes a concave portion which engages with the protrusion in the opening portion, wherein the conductive member includes an inclined surface portion which is formed on a rear side of the protrusion and extends so as to be close to a side, on which the protrusion is provided, toward a lower side, and wherein the biasing portion of the elastic member elastically contacts the inclined surface portion.

6. The electronic component socket according to claim 5, wherein the shield body is integrally formed and is formed of a resin molded piece to which metal plating is applied, and the concave portion is formed by molding.

7. The electronic component socket according to claim 5, wherein the shield body is formed of a metal plate, and the concave portion is formed by protrusion-processing the metal plate.

8. The electronic component socket according to claim 5, wherein the movement member includes: a first protrusion which is provided on one side with respect to a first center line bisecting an opening end portion of the opening portion in a plan view and on one side with respect to a second center line orthogonal to the first center line, and protrudes toward the shield body; and a second protrusion which is provided on the other side with respect to the first center line and on the other side with respect to the second center line, and protrudes in a direction opposite to the protrusion direction of the first protrusion, wherein the shield body includes: a first concave portion which is provided on one side with respect to the first center line and on one side with respect to the second center line, and engages with the first protrusion; and a second concave portion which is provided on the other side with respect to the first center line and on the other side with respect to the second center line, and engages with the second protrusion, wherein the inclined surface portion of the conductive member includes: a first inclined surface portion which is formed on a rear side of the first protrusion and extends so as to be close to the side, on which the first protrusion is provided, toward a lower side; and a second inclined surface portion which is formed on a rear side of the second protrusion and extends so as to be close to the side, on which the second protrusion is provided, toward a lower side, and wherein the biasing portion of the elastic member includes a first elastic contact portion which elastically contacts the first inclined surface portion, and a second elastic contact portion which elastically contacts the second inclined surface portion.

* * * * *